US008613610B2

(12) United States Patent
Saga et al.

(10) Patent No.: US 8,613,610 B2
(45) Date of Patent: Dec. 24, 2013

(54) VARIABLE DISPLACEMENT PUMP

(75) Inventors: Koji Saga, Ebina (JP); Hideaki Ohnishi, Atsugi (JP); Yasushi Watanabe, Kanagawa (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 629 days.

(21) Appl. No.: 12/947,084

(22) Filed: Nov. 16, 2010

(65) Prior Publication Data

US 2011/0123379 A1 May 26, 2011

(30) Foreign Application Priority Data

Nov. 25, 2009 (JP) ..... 2009-266950

(51) Int. Cl.

| | |
|---|---|
| ***F01C 20/18*** | (2006.01) |
| ***F01C 1/00*** | (2006.01) |
| ***F04C 28/18*** | (2006.01) |
| ***F04C 14/18*** | (2006.01) |
| ***F04C 2/00*** | (2006.01) |
| ***F04C 18/00*** | (2006.01) |
| ***F03C 2/00*** | (2006.01) |
| ***F03C 4/00*** | (2006.01) |

(52) U.S. Cl.

USPC ..... 418/260; 418/24; 418/25; 418/26; 418/27; 418/259; 418/261; 418/262

(58) Field of Classification Search

USPC ..... 418/24–27, 30, 259, 260, 262

See application file for complete search history.

(56) References Cited

U.S. PATENT DOCUMENTS

| | | | | |
|---|---|---|---|---|
| 8,282,369 | B2 * | 10/2012 | Yamamuro et al. | 418/30 |
| 2004/0136853 | A1 * | 7/2004 | Clements et al. | 418/24 |
| 2004/0144354 | A1 * | 7/2004 | Staley et al. | 123/196 R |
| 2009/0074598 | A1 * | 3/2009 | Tanasuca | 418/27 |
| 2009/0129960 | A1 * | 5/2009 | Yamamuro et al. | 418/260 |

FOREIGN PATENT DOCUMENTS

| | | |
|---|---|---|
| JP | 60-187779 | 9/1985 |
| JP | 07-158558 | 6/1995 |
| JP | 2009-92051 | 4/2009 |

* cited by examiner

*Primary Examiner* — Kenneth Bomberg
*Assistant Examiner* — Dapinder Singh
(74) *Attorney, Agent, or Firm* — Antonelli, Terry, Stout & Kraus, LLP.

(57) ABSTRACT

A variable displacement pump includes a pump structural member configured to change volumes of a plurality of working chambers by rotation of a rotor, so as to introduce oil through an inlet port into the working chambers and to discharge the oil through a discharge port, and further configured to oscillate a cam ring by a discharge pressure introduced into a control oil chamber. A first coil spring is provided to force the cam ring in a direction for increasing of a rate of change of the working-chamber volume. A second coil spring is provided to force the cam ring in a direction for decreasing of the rate of change of the working-chamber volume. The first and second coil springs are laid out on both sides of an arm portion of the cam ring in a manner so as to be opposed to each other.

18 Claims, 7 Drawing Sheets

VARIABLE DISPLACEMENT PUMP

TECHNICAL FIELD

The present invention relates to a variable displacement pump that supplies a variable valve actuation device configured to control engine-valve operating characteristics, moving engine parts of an automotive vehicle and the like, with oil.

BACKGROUND ART

In recent years, there have been proposed and developed various variable displacement pumps capable of varying a discharge of working fluid, usually expressed as a fluid flow rate per one revolution of a pump rotor. A variable displacement pump of this type has been disclosed in Japanese Patent Provisional Publication No. 2009-92023 (hereinafter is referred to as "JP2009-092023") assigned to the assignee of the present invention. In the variable displacement vane pump disclosed in JP2009-092023, its discharge is variably adjusted by changing an eccentricity of the geometric center of a cylinder bore of a cam ring with respect to the axis of rotation of a vane rotor. One end of the cam ring is pivoted on a pump housing. The vane rotor is accommodated in an inner periphery of the cam ring and driven by torque transmitted from an engine crankshaft. A plurality of vanes are fitted into an outer periphery of the rotor in a manner so as to radially slide from the rotor toward the inner peripheral surface of the cam ring, and laid out to be kept in abutted-engagement with the inner peripheral surface of the cam ring. The vanes are configured to define a plurality of variable-volume pump working chambers in cooperation with the outer peripheral surface of the rotor, the inner peripheral surface of the cam ring, and two axially opposed sidewalls facing both sides of the cam ring respectively. Also provided is a double-spring biasing device comprised of inner and outer coil springs and configured to force the cam ring in a direction that the volume difference between a volume of the largest working chamber and a volume of the smallest working chamber increases, in other words, in a direction that the eccentricity of the cam ring with respect to the rotation center of the vane rotor increases. The double-spring biasing device disclosed in JP2009-092023 is laid out to produce a nonlinear spring characteristic that a spring constant discontinuously increases, as the amount of oscillating motion (pivotal motion) of the cam ring increases in a direction that the volume difference between a volume of the largest working chamber and a volume of the smallest working chamber decreases, thereby ensuring a two-stage pump flow rate characteristic.

SUMMARY OF THE INVENTION

However, in the variable displacement pump disclosed in JP2009-092023, immediately when the eccentricity of the cam ring becomes reduced to below a predetermined eccentricity corresponding to a discontinuity point of the nonlinear spring characteristic owing to high discharge pressure produced by the pump during operation at high revolution speeds, a compressive deformation of the outer coil spring starts to develop in addition to a compressive deformation of the inner coil spring. Thus, after the discontinuity point has been reached, the summed spring load of the inner and outer coil springs acts on the cam ring and as a result the spring constant becomes discontinuously increased.

The double-spring biasing device having such a discontinuously-increased spring constant acts as an undesirable obstruction load resistance to a further cam-ring oscillating motion that the eccentricity of the cam ring is further reduced from the predetermined eccentricity. Thus, there is a possibility of an excessive discharge of the pump during operation at high pump revolution speeds. This leads to the problem of wasteful energy consumption.

It is, therefore, in view of the previously-described disadvantages of the prior art, an object of the invention to provide a variable displacement pump configured to appropriately suppress an excessive rise in the discharge of the pump even during operation at high pump revolution speeds.

In order to accomplish the aforementioned and other objects of the present invention, a variable displacement pump comprises a rotor driven by an internal combustion engine, a plurality of vanes fitted into an outer periphery of the rotor to be retractable and extendable in a radial direction of the rotor, a cam ring configured to accommodate therein the rotor and the vanes and configured to define a plurality of working chambers in cooperation with an outer peripheral surface of the rotor and two axially opposed sidewalls facing respective side faces of the cam ring, and further configured to change an eccentricity of a geometric center of the cam ring to an axis of rotation of the rotor by a displacement of the cam ring relative to the rotor, a housing configured to accommodate therein the cam ring and having an inlet portion and a discharge portion formed in at least one of the two axially opposed sidewalls, the inlet portion being configured to open into the working chambers whose volumes increase during rotation of the rotor in an eccentric state of the geometric center of the cam ring to the axis of rotation of the rotor, and the discharge portion being configured to open into the working chambers whose volumes decrease during rotation of the rotor in the eccentric state of the geometric center of the cam ring to the axis of rotation of the rotor, a first biasing member configured to force the cam ring by a first force in a first direction that the eccentricity of the geometric center of the cam ring to the axis of rotation of the rotor increases, a second biasing member configured to force the cam ring by a second force less than the first force in a second direction that the eccentricity of the geometric center of the cam ring to the axis of rotation of the rotor decreases, when the eccentricity of the geometric center of the cam ring is greater than or equal to a predetermined eccentricity, and further configured to be held in a specified preload state without any application of the second force to the cam ring, when the eccentricity of the geometric center of the cam ring is less than the predetermined eccentricity, and a control oil chamber configured to move the cam ring against the first force of the first biasing member by a discharge pressure introduced into the control oil chamber.

According to another aspect of the invention, a variable displacement pump comprises a rotor driven by an internal combustion engine, a plurality of vanes fitted into an outer periphery of the rotor to be retractable and extendable in a radial direction of the rotor, a cam ring configured to accommodate therein the rotor and the vanes and configured to define a plurality of working chambers in cooperation with an outer peripheral surface of the rotor and two axially opposed sidewalls facing respective side faces of the cam ring, and further configured to change an eccentricity of a geometric center of the cam ring to an axis of rotation of the rotor by a displacement of the cam ring relative to the rotor, a housing configured to accommodate therein the cam ring and having an inlet portion and a discharge portion formed in at least one of the two axially opposed sidewalls, the inlet portion being configured to open into the working chambers whose volumes increase during rotation of the rotor in an eccentric state of the geometric center of the cam ring to the axis of rotation of the rotor, and the discharge portion being configured to open into the working chambers whose volumes decrease during rotation of the rotor in the eccentric state of the geometric center of the cam ring to the axis of rotation of the rotor, a first coil spring configured to be always kept in abutted-engagement with the cam ring to force the cam ring by a first spring load in a first direction that the eccentricity of the geometric center of the cam ring to the axis of rotation of the rotor increases, a second coil spring configured to be kept out of contact with the cam ring, while being held in a compressed state, when the eccentricity of the geometric center of the cam ring is less than the predetermined eccentricity, and further configured to force the cam ring by a second spring load, produced by the second coil spring, which second coil spring is brought into abutted-engagement with the cam ring, and less than the first spring load, in a second direction that the eccentricity of the geometric center of the cam ring to the axis of rotation of the rotor decreases, when the eccentricity of the geometric center of the cam ring is greater than or equal to a predetermined eccentricity, and a control oil chamber configured to move the cam ring against the first spring load of the first coil spring by a discharge pressure introduced into the control oil chamber.

According to a further aspect of the invention, a variable displacement pump comprises a rotor driven by an internal combustion engine, a pump structural member configured to change a volume of each of a plurality of working chambers by rotation of the rotor, so as to introduce oil through an inlet portion into the working chambers and to discharge the oil through a discharge portion, a variable mechanism configured to variably adjust the volumes of the working chambers, which chambers open into the discharge portion, by a displacement of a movable member, caused by a discharge pressure of the oil discharged from the discharge portion, a first biasing member configured to force the movable member by a first force in a first direction that a rate of change of the volume of each of the working chambers increases, a second biasing member configured to force the movable member by a second force less than the first force in a second direction that a rate of change of the volume decreases, under a state where the movable member has been displaced to a position that the rate of change of the volume is greater than or equal to a predetermined value, and further configured to be held in a specified preload state without any application of the second force to the movable member, under a state where the movable member has been displaced to a position that the rate of change of the volume is less than the predetermined value, and a control oil chamber configured to move the movable member against the first force of the first biasing member by a discharge pressure introduced into the control oil chamber.

The other objects and features of this invention will become understood from the following description with reference to the accompanying drawings.

DESCRIPTION OF THE PREFERRED EMBODIMENTS

First Embodiment

Figure 1:
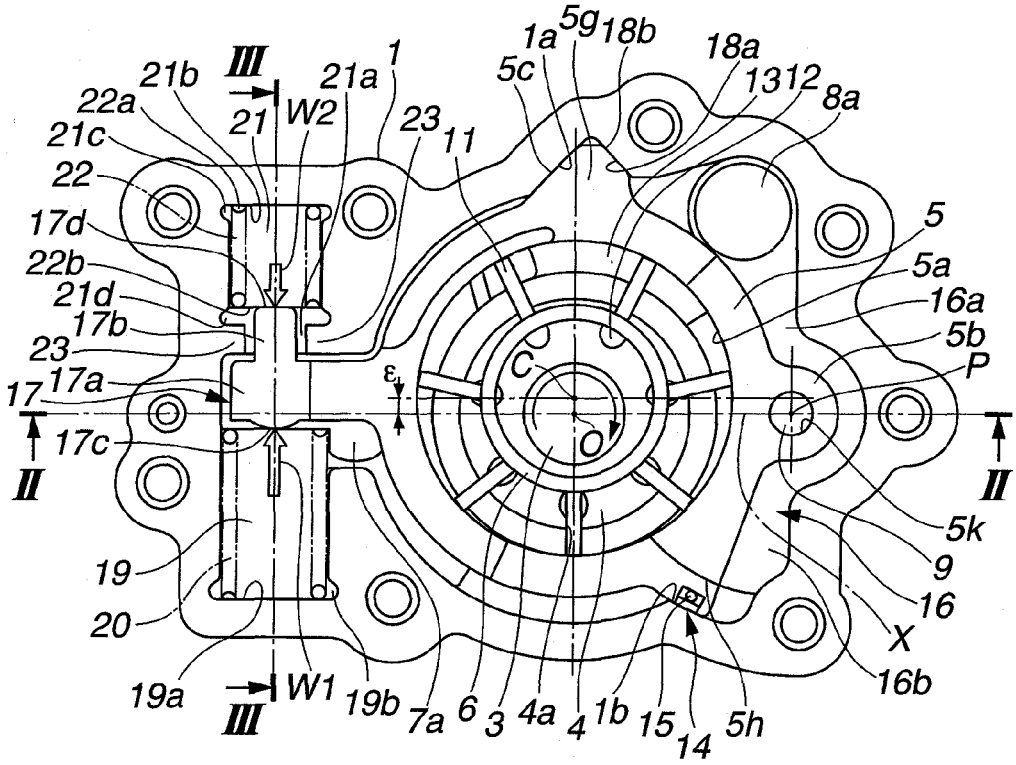
FIG. 1 is a front elevation view illustrating the internal construction of a variable displacement pump of the first embodiment in which a cam ring is kept at its initial setting position (the maximum-eccentricity angular position), but with a pump cover removed.
Figure 2:
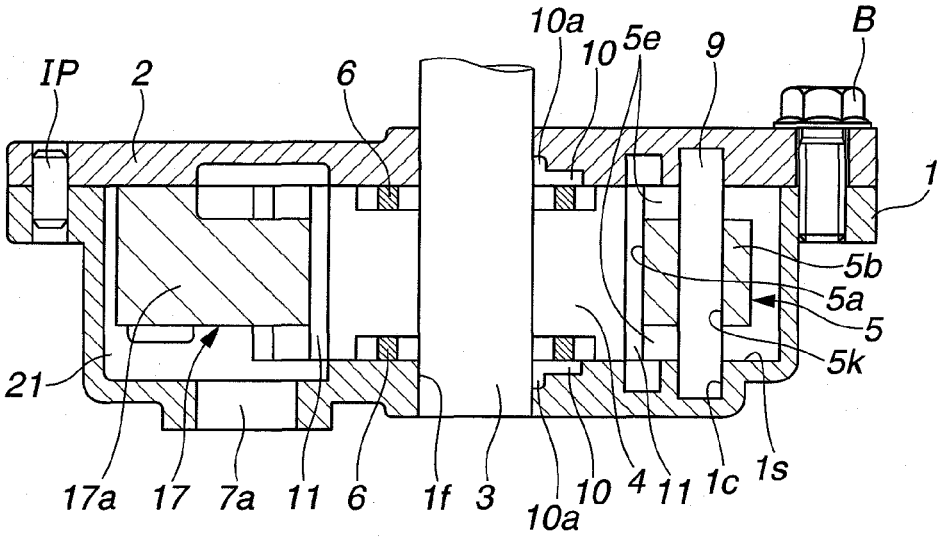
FIG. 2 is a cross-sectional view of the variable displacement pump of the first embodiment, taken along the line II-II of FIG. 1.

Referring now to the drawings, particularly to FIGS. 1-6, the variable displacement pump of the first embodiment is applied to an internal combustion engine of an automotive vehicle, for supplying moving engine parts with lubricating oil and for delivering oil (serving as a working medium as well as a lubricating substance) to a variable valve actuation device, which is installed for variably controlling engine valve operating characteristics of an internal combustion engine. The variable displacement pump of the first embodiment is exemplified in a vane type variable displacement rotary pump and installed on the front end of a cylinder block of the internal combustion engine. As shown in FIGS. 1-2, the variable displacement pump of the first embodiment is comprised of a pump housing 1, a pump cover 2, a drive shaft 3, a vane rotor 4, a cam ring (a movable member) 5, and a pair of vane rings 6, 6. Pump housing 1 is formed into a substantially cylindrical shape and closed at one axial end (a basal portion).

The opening end (the other axial end) of pump housing 1 is hermetically closed by the pump cover 2. Drive shaft 3 is installed to penetrate a substantially central portion of the basal portion of pump housing 1 and driven by an engine crankshaft (not shown). Rotor 4 is rotatably accommodated in the pump housing 1 and fixedly connected onto the drive shaft 3. As best seen in FIG. 2, rotor 4 has a substantially I-shaped cross section. Cam ring 5 is a movable member, which is pivotably installed in a manner so as to be slidable relative to each of pump housing 1 and pump cover 2, while accommodating therein the rotor 4. Vane rings 6, 6 are installed in respective sidewalls of the inner peripheral portion of rotor 4, so that sliding motions of vane rings 6, 6 relative to the respective sidewalls of the inner peripheral portion of rotor 4 are permitted.

Figure 4:
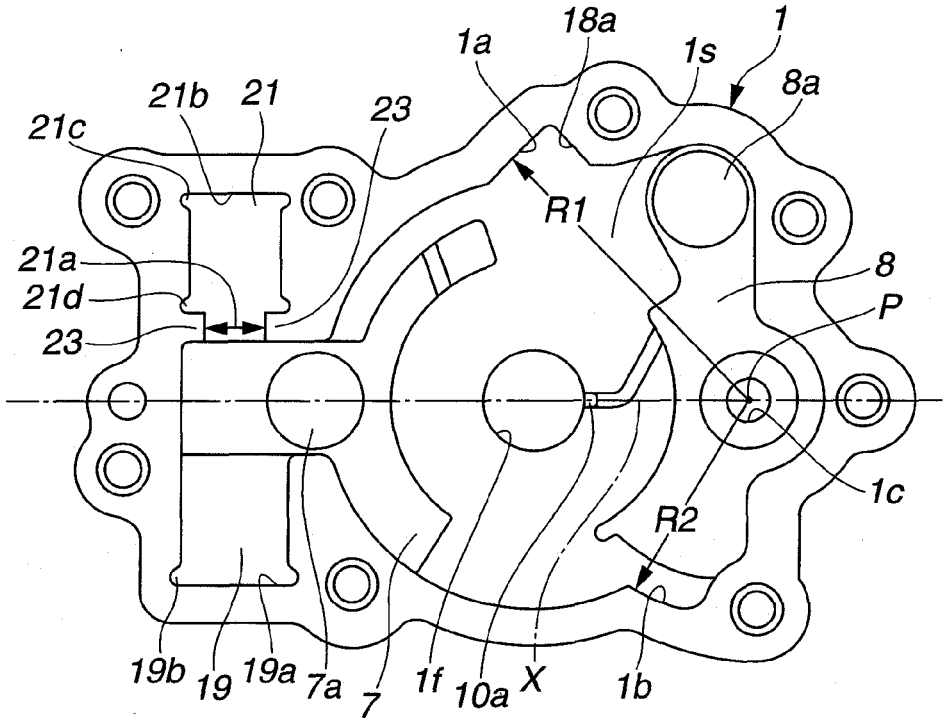
FIG. 4 is a front elevation view illustrating a pump housing of the variable displacement pump of the first embodiment.

Pump housing 1 has the above-mentioned basal portion, a peripheral wall extending from the perimeter of the basal portion, and a flanged portion. The basal portion, the peripheral wall, and the flanged portion, constructing a housing body of pump housing 1, are formed integral with each other, and made of aluminum alloy materials. As shown in FIG. 4, a bottom face 1*s* of the recessed portion defined by the basal portion and the peripheral wall of pump housing 1 is in sliding-contact with one axial sidewall of cam ring 5, and thus both the flatness and the surface roughness of bottom face 1*s* are more accurately machined.

As seen in FIGS. 1-2, pump housing 1 has a pin insertion hole 1*c* closed at one end and formed at a predetermined position of the basal portion. A pivot pin 9, serving as a pivot of cam ring 5, is inserted and fitted into the pin insertion hole 1*c*. Pump housing 1 has a first circular-arc concave sealing surface 1*a* partly formed on the upper-half peripheral wall with respect to a straight line "X" (hereinafter referred to as "cam-ring reference line") through the axis of pivot pin 9 and the center "O" of pump housing 1 (exactly, the axis "O" of drive shaft 3), when viewed in an axial direction defined by the axis of drive shaft 3. In a similar manner, pump housing 1 has a second circular-arc concave sealing surface 1*b* partly formed on the lower-half peripheral wall with respect to the cam-ring reference line "X".

The first sealing surface 1*a* is kept in sliding-contact with a first-seal circular-arc convex sliding-contact surface 5*c* formed on the outer periphery of cam ring 5. The first sealing surface 1*a* of the pump housing side and the sliding-contact surface 5*c* of the cam ring side cooperate with each other to provide a first seal (1*a*, 5*c*), by which the uppermost end of a first control oil chamber 16*a*, constructing part of a control oil chamber 16 (described later), can be partitioned and sealed in a fluid-tight fashion.

In a similar manner, the second sealing surface 1*b* is kept in sliding-contact with a second seal member 14 attached to the outer periphery of cam ring 5. The second sealing surface 1*b* of the pump housing side and the second seal member 14 of the cam ring side cooperate with each other to provide a second seal (1*b*, 14), by which the lowermost end of a second control oil chamber 16*b*, constructing the remainder of the control oil chamber 16, can be partitioned and sealed in a fluid-tight fashion.

As clearly shown in FIG. 4, the first sealing surface 1*a* is formed into a circular-arc shape with a radius "R1" which is equal to a distance from the center "P" of pin insertion hole 1*c* to the first sealing surface 1*a*, whereas the second sealing surface 1*b* is formed into a circular-arc shape with a radius "R2" which is equal to a distance from the center "P" of pin insertion hole 1*c* to the second sealing surface 1*b*.

As best seen in FIGS. 1 and 4, pump housing 1 is also formed on the peripheral wall with a stopper surface 18*a* continuously extending from the clockwise end of first sealing surface 1*a* with radius "R1", whereas cam ring 5 is also formed with a stopper surface 18*b* continuously extending from the end of sliding-contact surface 5*c* in such a manner as to direct toward the control oil chamber 16. Stopper surface 18*a* of the pump housing side is formed along a straight line through the axis of pivot pin 9 (that is, the center "P" of pin insertion hole 1*c*) and the clockwise end of first sealing surface 1*a*. The maximum clockwise displacement of cam ring 5 is restricted by abutment between stopper surface 18*a* of the pump housing side and stopper surface 18*b* of the cam ring side. As described later in detail, for instance when there is a less development of hydraulic pressure in the control oil chamber 16 during the initial startup of the pump, cam ring 5 is kept at its initial setting position by a spring load (W1−W2) obtained by both a first biasing member (a first coil spring 20 described later) and a second biasing member (a second coil spring 22 described later) whose spring forces (W1, W2) act in two different directions. The initial setting position of cam ring 5, also corresponds to a cam-ring maximum-eccentricity angular position at which the eccentricity $\epsilon$ of the geometric center "C" of cam ring 5 to the axis "O" of rotation of the pump drive shaft 3 becomes a maximum value. As discussed above, the stopper surface 18*a* of the pump housing side serves to determine the initial setting position of cam ring 5 by abutment with the stopper surface 18*b* of the cam ring side. The stopper surface 18*a* of the pump housing side also cooperates with the stopper surface 18*b* of the cam ring side to form a leakproof seal by the sealing surfaces consisting of two stopper surfaces 18*a* and 18*b*, brought into abutted-engagement with each other, so as to prevent oil leakage under discharge pressure (under hydraulic pressure) in a state where the amount of oscillating motion of cam ring 5 is zero.

Pump housing 1 has a substantially crescent-shaped inlet port 7 formed in the left-hand half of the bottom face 1*s* with respect to the drive shaft 3. Also, pump housing 1 has a substantially sector discharge port 8 formed in the right-hand half of the bottom face 1*s* with respect to the drive shaft 3. Although it is not clearly shown in the drawings, the basal portion of pump housing 1 is also formed with oil storage portions, each formed as an oil groove having a predetermined depth and a predetermined width.

As seen in FIGS. 2 and 4, inlet port 7 is configured to communicate an inlet hole 7*a* through which lubricating oil from an oil pan (not shown) is introduced into the inlet port. On the other hand, discharge port 8 is configured to communicate through a discharge hole 8*a* via a main oil gallery (not shown) with moving and/or sliding engine parts and the variable valve actuation device such as a variable valve timing control (VTC) device. A discharge portion of the pump, from which a pump discharge pressure is discharged, is comprised of discharge hole 8*a* and discharge port 8, whereas an inlet portion of the pump, into which an inlet pressure is introduced, is comprised of inlet hole 7*a* and inlet port 7.

The basal portion of pump housing 1 is formed at a substantially central portion with a bearing bore (or a drive-shaft supporting bore) if for rotatably supporting the drive shaft 3. The basal portion of pump housing 1 is also formed with a substantially L-shaped oil-feeding groove 10. The radially innermost end of L-shaped oil-feeding groove 10 is formed as a short further-recessed groove 10*a*. Lubricating oil, discharged from the discharge port 8, is supplied through the short further-recessed groove 10*a* of L-shaped oil-feeding groove 10 into the bearing bore (the drive-shaft supporting bore) 1*f*. In the same manner as the L-shaped oil-feeding groove 10 and recessed groove 10*a*, formed in the bottom face 1*s* of pump housing 1, the inner peripheral wall of pump cover 2 is also formed with a substantially L-shaped oil-feeding groove 10 and a radially innermost recessed groove 10*a* (see FIG. 2). Thus, lubricating oil can be delivered through the oil-feeding groove 10 of pump housing 1 and the oil-feeding groove 10 of pump cover 2 to respective sidewalls of rotor 4 and respective side faces of each of a plurality of vanes 11 (described later), thus ensuring the enhanced lubricating performance.

As shown in FIG. 2, the inner periphery of pump cover 2 is formed into a substantially flat shape. As described previously, inlet hole 7*a*, discharge hole 8*a* and oil storage portions are formed in the pump housing side. Inlet hole 7*a*, discharge hole 8*a* and oil storage portions may be formed in the pump cover side. Pump cover 2 is installed on the flanged portion of pump housing 1 by a plurality of bolts B, while the circumferential position of pump cover 2 relative to pump housing 1 is positioned by means of a plurality of positioning pins IP. In the same manner as the bearing bore (the drive-shaft supporting bore) 1*f* formed at the substantially central portion of the basal portion of pump housing 1, pump cover 2 is also formed at a substantially central portion with a bearing bore (or a drive-shaft supporting bore) (see FIG. 2). Drive shaft 3 is inserted into the two bearing bores of pump housing 1 and pump cover 2, such that drive shaft 3 is rotatably supported by means of the two bearing bores. Drive shaft 3 and rotor 4 are integrally connected to each other by press-fitting drive shaft 3 into the central bore of rotor 4, and thus rotor 4, together with drive shaft 3, is driven by the engine crankshaft. That is, rotor 4, together with drive shaft 3, rotates in the clockwise direction (viewing FIG. 1) in synchronism with rotation of the crankshaft. In FIG. 1, the left-hand half area of the pump body with respect to the drive shaft 3 corresponds to a suction area, whereas the right-hand half area of the pump body with respect to the drive shaft 3 corresponds to a discharge area.

As shown in FIG. 1, in the shown embodiment, the plurality of vanes 11 of the pump are seven vanes 11. These vanes 11 are the same in shape and formed into a rectangular shape. The width of each of vanes 11 is dimensioned to be substantially identical to the axial length of rotor 4 (see FIG. 2). Vanes 11 are fitted into respective slits 4*a* of rotor 4, in such a manner as to be slidable (retractable and extendable) in the radial direction of rotor 4. Each of slits 4*a* is formed at its basal portion with a back-pressure chamber 12 which has a circular cross-section and into which discharge pressure is introduced from the discharge port 8. The length of each of vanes 11 in the radial direction of rotor 4 is dimensioned to be shorter than the overall depth of each of slits 4*a* including back-pressure chambers 12.

The radially-inward end (the root) of each of vanes 11 is in abutted-engagement and sliding-contact with each of the outer peripheral surfaces of the vane-ring pair (6, 6). By means of the abutted portions of the vane-ring pair (6, 6), each of vanes 11 is supported with two points. The vane-ring pair (6, 6) has a function that pushes or forces each of vanes 11 outwards in the radial direction of rotor 4. The tip (the top end) of each of the radially-outward forced vanes 11 is in abutted-engagement and sliding-contact with an inner peripheral surface 5*a* of cam ring 5. The pump unit is constructed by pump housing 1, drive shaft 3, rotor 4, cam ring 5, inlet port 7, discharge port 8, and vanes 11. One pump working chamber is defined between two adjacent vanes 11. That is, seven variable-volume pump working chambers (simply, pump chambers) 13 are defined as seven internal spaces partitioned in a fluid-tight fashion and surrounded by vanes 11, the inner peripheral surface 5*a* of cam ring 5, the outer peripheral surface of rotor 4, and two axially opposed sidewalls (i.e., the bottom face 1*s* of pump housing 1 and the inside face of pump cover 2).

Cam ring 5 is substantially cylindrical in shape. Cam ring 5 is formed of a main cylindrical portion, a pivot portion 5*b*, a first protrusion portion (a first seal portion described later) 5*g*, a second protrusion portion (a second seal portion described later) 5*h*, and an arm portion 17 (described later). These portions 5*b*, 5*g*, 5*h*, and 17 are formed integral with the main cylindrical portion. Cam ring 5 is made of sintered alloy materials, such as easily-machined iron-based sintered alloy materials. As clearly seen in FIG. 1, pivot portion 5*b* is laid out on the cam-ring reference line "X" and formed at the rightmost end of cam ring 5. Pivot portion 5*b* has a pivot bore 5*k* formed as a through hole extending along the axial direction of cam ring 5. In the same manner as the pin insertion hole 1*c* closed at one end and formed in the basal portion of pump housing 1, pump cover 2 is also formed with a pin insertion hole closed at one end (see FIG. 2). Cam ring 5 is accommodated in the internal space of pump housing 1, under a condition where pivot pin 9 is inserted and fitted into the pivot bore 5*k*, and simultaneously fitted into the pin insertion holes of pump housing 1 and cover 2. Pivot portion 5*b* of cam ring 5 is rotatably supported by the pivot pin 9 in such a manner as to be pivotable about the pivot pin. That is, pivot pin 9 serves as a pivot of cam ring 5, in other words, a fulcrum of oscillating motion of cam ring 5.

The first protrusion portion 5*g* is formed as a substantially inverted U-shaped upper portion of cam ring 5 and located upwardly apart from the cam-ring reference line "X". The first protrusion portion 5*g* is formed on its outer periphery with the stopper surface 18*b* as well as the first-seal circular-arc convex sliding-contact surface 5*c*. On the other hand, the second protrusion portion 5*h* is formed as a substantially triangular lower portion of cam ring 5 and located downwardly apart from the cam-ring reference line "X". The second protrusion portion 5*h* is formed with a seal-retention groove for retaining the second seal member 14.

The distance from the center "P" of pin insertion hole 1*c* (i.e., the center of pivot bore 5*k*) to the first-seal sliding-contact surface 5*c* of the cam ring side is dimensioned to be slightly less than the radius "R1" of the first sealing surface 1*a* of the pump housing side. Hence, a flow-constriction orifice is defined or formed by a very small aperture between the first-seal sliding-contact surface 5*c* of the cam ring side and the first sealing surface 1*a* of the pump housing side, closely fitted each other. By abutment of stopper surface 18*b* of the cam ring side with stopper surface 18*a* of the pump housing side, the maximum clockwise displacement of cam ring 5 can be reliably restricted. The stopper surface 18*a* of the pump housing side and the stopper surface 18*b* of the cam ring side, abutted each other, provides a good leakproof seal under a working condition of the pump before cam ring 5 begins to move counterclockwise from its initial setting position due to a rise in hydraulic pressure, thus suppressing an internal oil leakage from the first control oil chamber 16*a* to the low-pressure side to a minimum. Additionally, even when the stopper surface 18*b* of the cam ring side is moving apart from the stopper surface 18*a* of the pump housing side owing to a further hydraulic pressure rise, the internal oil leakage can be suppressed to a minimum by means of the flow-constriction orifice formed by the very small aperture between the cam-ring sliding-contact surface 5*c* and the pump-housing first sealing surface 1*a*.

The second seal member 14 is made of a low-friction synthetic resin material and formed as an axially-elongated oil seal extending along the axial direction of cam ring 5. The second seal member 14 is retained and fitted into the seal-retention groove formed in the second protrusion portion 5*h*. A rubber elastic member (or an elastomeric member) 15 is attached onto the innermost end face of the seal-retention groove. Thus, the second seal member 14 of cam ring 5 is permanently forced toward the second sealing surface 1*b* of pump housing 1 by the elastic force of rubber elastic member 15. The second sealing surface 1*b* of pump housing 1 and the second seal member 14 of cam ring 5, abutted each other, provides a good leakproof seal, thus suppressing an internal oil leakage from the second control oil chamber 16*b* to the low-pressure side to a minimum.

As seen in FIGS. 1-2, cam ring 5 is also formed with a pair of fluid-communication grooves 5*e*, 5*e* formed on both sides of cam ring 5 in a manner so as to extend from an angular position near the clockwise end (in the rotation direction of rotor 4) of discharge port 8 via the pivot portion 5*b*, whose both sides are machined and somewhat thinned, to an angular position near the counterclockwise end (in the rotation direction of rotor 4) of discharge port 8. The inside portion of cam ring 5 is communicated with the first and second oil control chambers 16*a*-16*b* through the fluid-communication groove pair (5*e*, 5*e*). As can be appreciated from FIGS. 1-2, in the shown embodiment, regarding each side face of cam ring 5, the upper fluid-communication groove 5*e* above the cam-ring reference line "X" and the lower fluid-communication groove 5*e* below the cam-ring reference line "X" are continuous with each other. In lieu thereof, in order to enhance the mechanical strength of pivot portion 5*b*, two pairs of fluid-communication grooves (5*e*, 5*e*; 5*e*, 5*e*) may be formed on both sides of cam ring 5 without machining both sides of pivot portion 5*b*, such that the upper fluid-communication groove pair (5*e*, 5*e*) of cam ring 5 and the lower fluid-communication groove pair (5*e*, 5*e*) of cam ring 5 are separated from each other by the thick pivot portion 5*b*, whose axial thickness is dimensioned to be substantially identical to the axial length of rotor 4.

The previously-discussed control oil chamber 16 is constructed by the first and second control oil chambers 16*a*-16*b*. In more detail, control oil chamber 16 is divided into the first control oil chamber (the upper control oil chamber) 16*a* and the second control oil chamber (the lower control oil chamber) 16*b* by the cam-ring reference line "X".

The first control oil chamber 16*a* is formed into a substantially crescent shape extending from the pivot portion 5*b* of cam ring 5 via the upper right portion of the outer peripheral surface of cam ring 5 toward the upper sliding-contact, closely-fitted pair (i.e., the first-seal sliding-contact surface 5*c* of cam ring 5 and the first sealing surface 1*a* of pump housing 1), and also formed in the upper half of the right-hand half discharge area of the pump body with respect to the cam-ring reference line "X". The hydraulic pressure of working oil, discharged from discharge port 8 and introduced into the first control oil chamber 16*a*, acts on the upper right portion of the outer peripheral surface of cam ring 5 above the cam-ring reference line "X". Thus, in the front elevation view of FIG. 1, the hydraulic pressure in the first control oil chamber 16*a* acts on the cam ring 5 so as to produce a counterclockwise oscillating motion (or a counterclockwise pivotal motion) of cam ring 5 about the pivot (i.e., pivot pin 9) in a direction that the eccentricity $\epsilon$ of the geometric center "C" of cam ring 5 to the axis "O" of rotation of drive shaft 3 (i.e., the axis "O" of rotation of rotor 4) decreases.

On the other hand, the second control oil chamber 16*b* is formed into a substantially crescent shape extending from the pivot portion 5*b* of cam ring 5 via the lower right portion of the outer peripheral surface of cam ring 5 toward the lower sliding-contact, closely-fitted pair (i.e., the second seal member 14 of cam ring 5 and the second sealing surface 1*b* of pump housing 1), and also formed in the lower half of the right-hand half discharge area of the pump body with respect to the cam-ring reference line "X". The hydraulic pressure of working oil, discharged from discharge port 8 and introduced into the second control oil chamber 16*b*, acts on the lower right portion of the outer peripheral surface of cam ring 5 below the cam-ring reference line "X". Thus, in the front elevation view of FIG. 1, the hydraulic pressure in the second control oil chamber 16*b* acts on the cam ring 5 to produce a clockwise oscillating motion (or a clockwise pivotal motion) of cam ring 5 about the pivot (i.e., pivot pin 9) in a direction that the eccentricity $\epsilon$ of the geometric center "C" of cam ring 5 to the axis "O" of rotation of rotor 4 increases in a manner so as to return the cam ring 5 toward its initial setting position.

In designing the first and second control oil chambers 16*a*-16*b*, the pressure-receiving area of a portion of the outer peripheral surface of cam ring 5, associated with the first control oil chamber 16*a*, is dimensioned to be greater than the pressure-receiving area of a portion of the outer peripheral surface of cam ring 5, associated with the second control oil chamber 16*b*. Therefore, a push on a portion of the outer peripheral surface of cam ring 5, associated with the first control oil chamber 16*a* can be somewhat cancelled by a push on a portion of the outer peripheral surface of cam ring 5, associated with the second control oil chamber 16*b*. As a result of this, the force, which is produced by hydraulic pressure (discharge pressure) of working oil discharged from discharge port 8 and introduced into the first and second control oil chambers 16*a*-16*b* and acts to decrease the eccentricity $\epsilon$ of the geometric center "C" of cam ring 5 to the axis "O" of rotation of rotor 4 with a counterclockwise oscillating motion of cam ring 5 about the pivot (i.e., pivot pin 9), can be properly reduced. Hence, the spring force, which is produced by the first biasing member (the first coil spring 20) and acts to force or bias cam ring 5 clockwise against the force, produced by discharge pressure introduced into the control oil chamber 16 and acts to decrease the eccentricity $\epsilon$ of cam ring 5, can be set to a small value. By the way, an inlet pressure is introduced into an internal space defined between the inner peripheral surface of housing 1 and the outer peripheral surface of cam ring 5 except the control oil chamber 16, partitioned by the first and second sealing surface pairs (1*a*, 5*c*; 1*b*, 14). Thus, it is possible to adequately suppress oil leakage from a structural division except the control oil chamber 16.

As clearly shown in FIG. 1, cam ring 5 is formed integral with the arm portion 17 so that arm portion 17 and pivot portion 5*b* are arranged on the opposite sides of the main cylindrical portion of cam ring 5. As shown in FIGS. 1-2, arm portion 17 is comprised of a radially-outward protruding main arm body 17*a*, a pushrod 17*b* integrally formed on the upper face of the main arm body 17*a*, and a semi-spherical contacting surface protrusion 17*c* integrally formed on the lower face of the main arm body 17*a*. Main arm body 17*a* has a rectangular cross section. As can be seen from the front elevation view of FIG. 1, pushrod 17*b* is formed integral with the rectangular main arm body 17*a* so that the axis of pushrod 17*a* extends in a direction substantially perpendicular to the neutral axis of the radially-outward protruding rectangular main arm body 17*a*. The top face 17*d* of pushrod 17*b* is formed as a curved surface having a small radius of curvature.

Pump housing 1 is formed with first and second spring chambers 19 and 21, so that the spring chamber pair (19, 21) and the pin insertion hole 1*c* are arranged on the opposite sides of pump housing 1 and that the first spring chamber 19 faces the underside of arm portion 17 and the second spring chamber 21 faces the upside of arm portion 17. The axis of first spring chamber 19 and the axis of second spring chamber 21 are coaxially aligned with each other.

The axis of pushrod 17*b* and the center of semi-spherical protrusion 17*c* are both configured to be aligned with the axis common to the coaxially-aligned two spring chambers 19 and 21, with cam ring 5 held at its initial setting position. As appreciated from comparison between a zero-angular-displacement state (a zero-counterclockwise-displacement state) of cam ring 5 shown in FIG. 1 and a large-angular-displacement state (a large-counterclockwise-displacement state) of cam ring 5 shown in FIG. 6, the angular displacement of cam ring 5 is small over the entire range of oscillating motion of cam ring 5. Hence, an inclination angle of the axis of pushrod 17*b* of arm portion 17 with respect to the common axis of first and second spring chambers 19 and 21 is slight.

Figure 3:
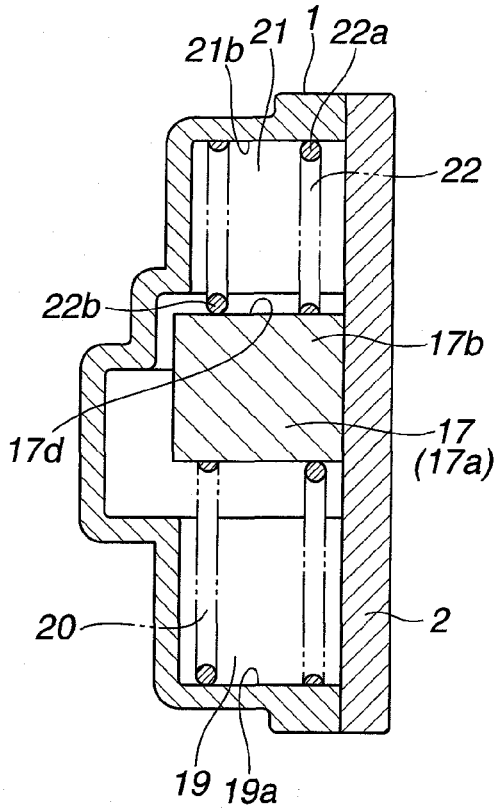
FIG. 3 is a cross-sectional view of the variable displacement pump of the first embodiment, taken along the line III-III of FIG. 1.

The first spring chamber (the lower spring chamber) 19 has a substantially rectangular lateral cross section having longer opposite sides in the axial direction of pump housing 1 (see FIGS. 1 and 3). As seen in FIG. 1, the rounded corners of the longer opposite sides of the rectangular bottom face 19*a* (serving as a spring seat) of first spring chamber 19 are further machined as recessed grooves 19*b*, 19*b* to prevent undesirable friction contact between the circumference of the lower end of first coil spring 20 and the corners of the rectangular bottom face 19*a*, and also to permit more smooth contraction and extension of first coil spring 20, in other words, more smooth spring-loading (biasing) action of first coil spring 20, with a superior spring-seat performance.

The second spring chamber (the upper spring chamber) 21 has a substantially rectangular lateral cross section having longer opposite sides in the axial direction of pump housing 1 (see FIGS. 1 and 3), in a similar manner to the first spring chamber 19. The longitudinal length of second spring chamber 21 is dimensioned to be shorter than that of first spring chamber 19, and also dimensioned to be shorter than a free height of second coil spring 22. Pump housing 1 has a pair of opposed shoulder (stepped) portions 23, 23. Opposed shoulder portions 23, 23 define or form the lower opening end 21*a* of second spring chamber 21 between them. Opposed shoulder portions 23, 23 are formed to inwardly protrude toward the common axis of the coaxially-aligned two spring chambers 19 and 21. Each of opposed shoulder portions 23, 23 has almost the same rectangular cross section. The distance between opposed shoulder portions 23, 23, that is, the width of the lower opening end 21*a*, is dimensioned to be slightly shorter than the coil outside diameter of second coil spring 22, and also dimensioned to be almost equal to the coil inside diameter of second coil spring 22. The lower opening end 21*a*, defined between opposed shoulder portions 23, 23, is configured to permit the pushrod 17*b* of arm portion 17 to move toward or apart from the lower end of second spring chamber 21 therethrough. By virtue of the distance between opposed shoulder portions 23, 23, dimensioned to be slightly shorter than the coil outside diameter of second coil spring 22, and almost equal to the coil inside diameter, the opposed shoulder pair (23, 23) serves as a stopper means that restricts a maximum extended stroke (an extensible deformation) of second coil spring 22.

As seen in FIG. 1, the rounded corners of the longer opposite sides of the rectangular upper face 21*b* of second spring chamber 21 are further machined as recessed grooves 21*c*, 21*c*, to prevent undesirable friction contact between the circumference of the upper end of second coil spring 22 and the corners of the rectangular upper face 21*b*. In a similar manner, the rounded corners of the longer opposite sides of the rectangular upper face of the opposed shoulder pair (23, 23) of second spring chamber 21 are further machined as recessed grooves 21*d*, 21*d*, to prevent undesirable friction contact between the circumference of the lower end of second coil spring 22 and the corners of the rectangular upper face of the opposed shoulder pair (23, 23). The previously-discussed recessed grooves (19*b*, 19*b*), (21*c*, 21*c*) and (21*d*, 21*d*) contribute to a superior spring-seat performance for each of two opposed coil springs 20 and 22.

The first coil spring 20 is operably accommodated in the first spring chamber 19. The first coil spring 20 serves as a biasing member by which cam ring 5 is biased through the arm portion 17 in the clockwise direction (viewing FIG. 1), that is, in the direction that the eccentricity $\epsilon$ of the geometric center "C" of cam ring 5 to the axis "O" of rotation of rotor 4 increases.

When assembling, the first coil spring 20 is disposed between the semi-spherical protrusion 17*c* of main arm body 17*a* and the bottom face 19*a* of first spring chamber 19, under preload. The top face of first coil spring 20 is always kept in abutted-engagement with the semi-spherical protrusion 17*c* over the entire range of oscillating motion of cam ring 5 during operation of the pump. More concretely, the top face of first coil spring 20 is kept in elastic-contact with the semi-spherical protrusion 17*c* of main arm body 17*a*, whereas the bottom face of first coil spring 20 is kept in elastic-contact with the bottom face 19*a* of first spring chamber 19. Thus, the arm portion 17 of cam ring 5 is permanently forced or biased by a spring load (a spring force) W1, produced by first coil spring 20, in the clockwise direction (viewing FIG. 1) that the eccentricity $\epsilon$ of the geometric center "C" of cam ring 5 to the axis "O" of rotation of rotor 4 increases.

The second coil spring 22 is operably accommodated in the second spring chamber 21. The second coil spring 22 serves as a biasing member by which cam ring 5 is biased through the arm portion 17 in the counterclockwise direction (viewing FIG. 1).

The top face 22*a* of second coil spring 22 is kept in elastic-contact with the upper face 21*b* of second spring chamber 21, whereas the bottom face 22*b* of second coil spring 22 is kept in elastic-contact with the top face 17*d* of pushrod 17*b* of arm portion 17, within a first angular-displacement range of cam ring 5, ranging from the initial setting position of cam ring 5 (i.e., the maximum-eccentricity angular position, in other words, the zero-angular-displacement state of cam ring 5) to an angular position just before an intermediate-eccentricity holding state where the cam-ring eccentricity $\epsilon$ is held at a substantially intermediate value corresponding to the predetermined eccentricity $\epsilon 0$ and the bottom face 22*b* of second coil spring 22 is brought into abutted-engagement with the opposed shoulder pair (23, 23). Note that, even under the intermediate-eccentricity holding state of cam ring 5, the second coil spring 22 is kept in a compressed state (a specified preload state) by means of the opposed shoulder pair (23, 23) of pump housing 1. Thus, within the first angular range from the cam-ring initial setting position to the angular position just before the cam-ring intermediate-eccentricity holding state, the push rod 17*b* of arm portion 17 of cam ring 5 is forced or biased by a spring load (a spring force) W2, produced by second coil spring 22, in the counterclockwise direction (viewing FIG. 1) that the eccentricity $\epsilon$ of the geometric center "C" of cam ring 5 to the axis "O" of rotation of rotor 4 decreases.

Within the previously-noted first angular range of cam ring 5, by virtue of the previously-discussed coaxial layout of first and second spring chambers 19 and 21 coaxially aligned with each other on both sides of arm portion 17 in the opposite directions of movement (exactly, angular displacement) of cam ring 5, the spring loads W1 and W2 have almost the same line of action but different direction. Additionally, the magnitude of spring load W2, produced by second coil spring 22, is set to be less than that of spring load W1, produced by first coil spring 20. Hence, when there is a less development of hydraulic pressure of working oil discharged from the discharge port during the initial startup of the pump, cam ring 5 is kept at its initial setting position (i.e., the maximum-eccentricity angular position) by a spring load difference (W1−W2) between spring loads W1 and W2, acting in two different directions.

More concretely, in the first embodiment, the first coil spring 20 functions to permanently force or bias the arm portion 17 of cam ring 5 upward (viewing FIG. 1) in a direction that the eccentricity ϵ of the geometric center "C" of cam ring 5 to the axis "O" of rotation of rotor 4 increases, that is, in a direction that the volume difference between a volume of the largest working chamber of pump chambers 13 and a volume of the smallest working chamber of pump chambers 13 increases, in other words, in a direction that the rate of change of the volume of each of pump chambers 13 increases. The spring load W1, produced by first coil spring 20 with cam ring 5 kept at its initial setting position (i.e., the maximum-eccentricity angular position) shown in FIG. 1, is set to a spring force that cam ring 5 begins to move (oscillate) counterclockwise from the initial setting position when the discharge pressure from the pump (that is, the hydraulic pressure in control oil chamber 16) reaches a hydraulic pressure P1 required for a variable valve timing control (VTC) device.

Figure 5:
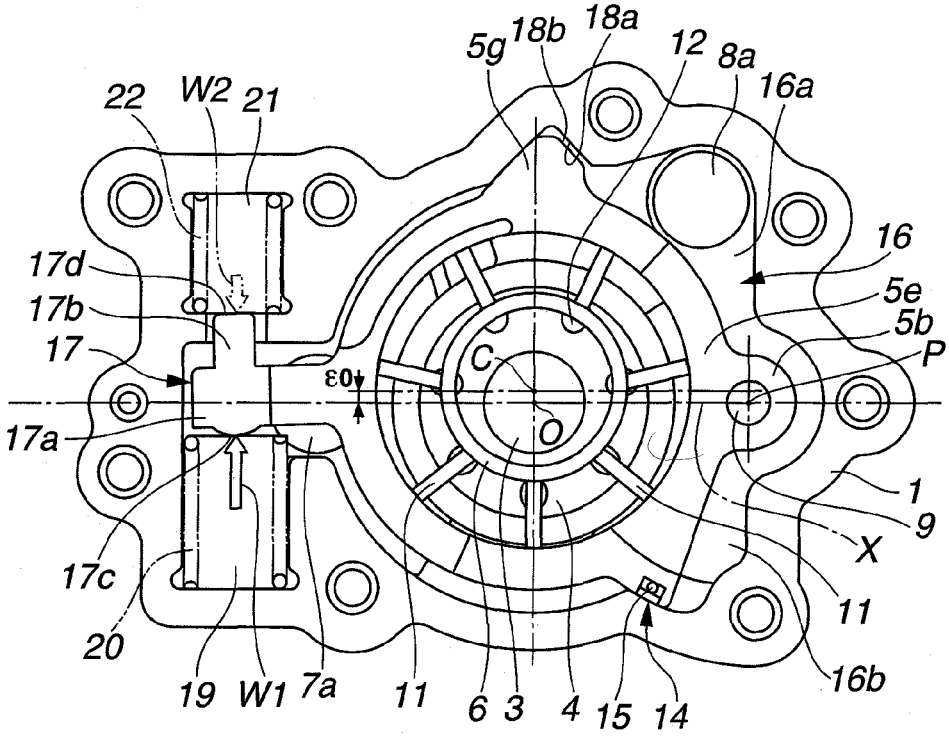
FIG. 5 is an explanatory view illustrating the operation of the variable displacement pump of the first embodiment in an intermediate-eccentricity holding state (an intermediate-eccentricity holding position) where the cam-ring eccentricity $\epsilon$ is held at a substantially intermediate value corresponding to a predetermined eccentricity $\epsilon 0$.

As seen from the front elevation view of FIG. 1, the bottom face 22*b* of second coil spring 22 is kept in abutted-engagement (elastic-contact) with the top face 17*d* of pushrod 17*b* of arm portion 17, when the eccentricity ϵ of the geometric center "C" of cam ring 5 to the axis "O" of rotation of rotor 4 is greater than or equal to the predetermined eccentricity ϵ shown in FIG. 5. In contrast, when the eccentricity ϵ of the geometric center "C" of cam ring 5 to the axis "O" of rotation of rotor 4 is less than the predetermined eccentricity ϵ0, as appreciated from the front elevation view of FIG. 6, the bottom face 22*b* of second coil spring 22 is kept in abutted-engagement with the opposed shoulder pair (23, 23), while second coil spring 22 remains kept in its compressed state by means of the opposed shoulder pair (23, 23), but the bottom face 22*b* of second coil spring 22 is out of elastic-contact with the top face 17*d* of pushrod 17*b* of arm portion 17. In more detail, as best seen in FIG. 5, immediately before the predetermined eccentricity ϵ0 of cam ring 5 has been reached, the upward spring load W1, produced by first coil spring 20 and indicated by the voided vector in FIG. 5, acts on the underside (i.e., semi-spherical protrusion 17*c*) of arm portion 17, whereas the downward spring load W2, produced by second coil spring 22 and indicated by the two-dotted phantom vector in FIG. 5, acts on the upside (i.e., the top face 17*d* of pushrod 17*b*) of arm portion 17. Immediately after the predetermined eccentricity ϵ0 has been reached, the upward spring load W1, produced by first coil spring 20 and indicated by the voided vector in FIG. 5, acts on the underside (i.e., semi-spherical protrusion 17*c*) of arm portion 17, whereas the downward spring load W2, produced by second coil spring 22 and indicated by the two-dotted phantom vector in FIG. 5, does not act on the upside of arm portion 17 any longer, since the maximum extended stroke (the extensible deformation) of second coil spring 22 has already been restricted by the opposed shoulder pair (23, 23). The spring load W1, produced by first coil spring 20, immediately after the predetermined eccentricity ϵ0 has been reached (see FIG. 5) and thus the spring load W2 acting on the arm portion 17 becomes zero, is set to a spring force that cam ring 5 begins to further move (oscillate) counterclockwise from the intermediate-eccentricity holding position (described later in detail), corresponding to the predetermined eccentricity ϵ0 of cam ring 5, when the discharge pressure from the pump (that is, the hydraulic pressure in control oil chamber 16) reaches a hydraulic pressure P2 required for a piston oil jet device for cooling-oil supply to the piston or when the discharge pressure from the pump reaches a hydraulic pressure P3 required for lubrication of a crank journal (a main bearing journal) of the engine crankshaft at maximum engine speed (at maximum crankshaft revolution speed).

A variable mechanism, configured to variably adjust a volume of each of the variable-volume pump chambers 13, is constructed by the cam ring 5, vane-ring pair (6, 6), control oil chamber 16 (exactly, first and second control oil chambers 16*a*-16*b*), first coil spring (first biasing member) 20, and second coil spring (second biasing member) 22.

Figure 7:
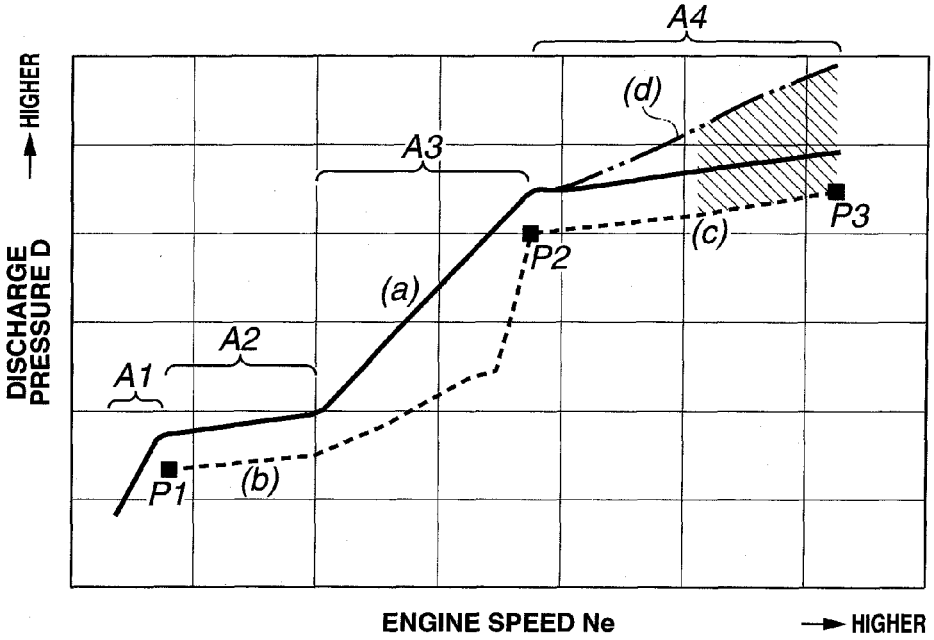
FIG. 7 is a characteristic diagram illustrating the difference between an engine-speed versus pump-discharge-pressure characteristic of the variable displacement pump of the first embodiment and an engine-speed versus pump-discharge-pressure characteristic of a variable displacement pump of a comparative example.

The operation of the variable displacement pump of the first embodiment is hereunder described in detail in reference to the engine-speed Ne versus discharge-pressure D characteristic diagram of FIG. 7.

In FIG. 7, the engine-speed Ne versus discharge-pressure D characteristic diagram "(a)" indicated by the solid line shows the Ne-D characteristic, obtained by the variable displacement pump of the first embodiment, using first and second coil springs 20 and 22 whose spring chambers are coaxially aligned with each other on both sides of arm portion 17 of cam ring 5. On the other hand, the engine-speed Ne versus discharge-pressure D characteristic diagram "(d)" partly indicated by the two-dotted line shows the Ne-D characteristic (in a speed range from middle engine speeds to high engine speeds), obtained by the variable displacement pump of the comparative example (as described in JP2009-092023), using a double-spring biasing device comprised of inner and outer coil springs whose spring forces act in the same direction. In a speed range from low engine speeds to middle engine speeds, the Ne-D characteristic, obtained by the variable displacement pump of the comparative example, is almost equal to that obtained by the variable displacement pump of the first embodiment and indicated by the solid line in FIG. 7.

In the case of internal combustion engines employing a VTC device for improved fuel economy and enhanced exhaust emission performance, a hydraulic pressure, produced by the oil pump, is also used as a driving power source for the VTC device. To enhance the control responsiveness of the VTC device, a pressure characteristic corresponding to the hydraulic pressure P1 required for the VTC device and indicated by the broken line "(b)" is required from a point of time when the engine speed Ne is still low. Also, in the case of oil-jet-equipped engines for piston cooling, a higher pressure characteristic corresponding to the hydraulic pressure P2 required for the piston oil jet device during operation of the engine at middle and/or high speeds and indicated by the broken line "(c)" is required. In a high engine speed range (in particular, at a maximum engine speed), the hydraulic pressure P3 required for lubrication of a crank journal of the engine crankshaft is required. For the reasons discussed above, it is desirable that a required Ne-D characteristic, required for the internal combustion engine over the entire range of engine speed, is equivalent to a total characteristic indicated by the broken line in FIG. 7 and obtained by properly connecting the pressure characteristic indicated by the broken line "(b)" and the pressure characteristic indicated by the broken line "(c)".

Generally, the pressure level of the middle-speed-range required hydraulic pressure P2 is less than that of the high-speed-range required hydraulic pressure P3 (that is, P2<P3), but there is an increased tendency for these required hydraulic pressures P2 and P3 to be in close proximity to each other (that is, P2≈P3). Thus, in a mid- and high-speed range A4 of FIG. 7, it is desirable or preferable that a rate of increase (rise) in discharge pressure D is suppressed to a small value, even when the engine speed Ne is gradually rising.

However, as can be seen from the Ne-D characteristic "(d)" of the variable displacement pump of the comparative example, using a double-spring biasing device comprised of inner and outer coil springs and indicated by the two-dotted line in FIG. 7, in the mid- and high-speed range A4, the cam ring is biased by the inner and outer coil springs whose spring forces act in the same direction. That is, owing to a combined spring constant (a high spring constant) of the inner and outer coil springs, the pump system of the comparative example has the difficulty in moving (oscillating) the cam ring in the mid- and high-speed range A4. As a result, the Ne-D characteristic "(d)" of the variable displacement pump of the comparative example exhibits a remarkable rise in the controlled discharge pressure in accordance with an engine speed rise in the mid- and high-speed range A4. That is to say, as appreciated from the diagonal shading area within the mid- and high-speed range A4 in FIG. 7, according to the pump system of the comparative example having the Ne-D characteristic "(d)", it is impossible to adequately suppress a power loss.

In contrast, the variable displacement pump of the first embodiment, using first and second coil springs 20 and 22 whose spring chambers are coaxially aligned with each other on both sides of arm portion 17 and whose spring forces act in different directions, operates as follows.

As can be seen from the Ne-D characteristic indicated by the solid line in FIG. 7, in an engine-startup- and very-low-speed range, the pump discharge pressure D does not yet reach the hydraulic pressure P1 and thus stopper surface 18*a* of the pump housing side and stopper surface 18*b* of the cam ring side are kept in abutted-engagement with each other by a spring load difference (W1−W2) between the spring load W1, produced by first coil spring 20, and the spring load W2, produced by second coil spring 22. Hence, in the engine-startup- and very-low-speed range, the arm portion 17 of cam ring 5 is kept in its stopped state with the result that cam ring 5 is kept at its initial setting position (see FIG. 1). At this time, the eccentricity ϵ of the geometric center "C" of cam ring 5 to the axis "O" of rotation of rotor 4 becomes maximum and thus the discharge capacity of the pump also becomes maximum. Therefore, in the engine-startup- and very-low-speed range, the discharge pressure D tends to rapidly rise in accordance with an engine speed rise (see the discharge pressure D characteristic indicated by the solid line in FIG. 7 in the engine speed range A1).

After the discharge pressure D has reached the hydraulic pressure P1 owing to a further engine speed rise, the hydraulic pressure introduced into the control oil chamber 16 also becomes higher. The arm portion 17 of cam ring 5 begins to compress the first coil spring 20 with a counterclockwise oscillating motion of cam ring 5 about the pivot (i.e., pivot pin 9). The eccentricity ϵ of cam ring 5 reduces, and thus the discharge capacity of the pump also reduces.

Therefore, in the low-speed range after the discharge pressure D has exceeded the hydraulic pressure P1, the discharge pressure D tends to slowly rise in accordance with an engine speed rise (see the discharge pressure D characteristic indicated by the solid line in FIG. 7 in the engine speed range A2). Hence, in this low-speed range A2, cam ring 5 oscillates counterclockwise with an engine speed rise (a discharge pressure rise), until the bottom face 22*b* of second coil spring 22 is brought into abutted-engagement with the opposed shoulder pair (23, 23) and thus the spring load W2, produced by second coil spring 22, does not act on the top face 17*d* of pushrod 17*b* of arm portion 17 anymore (see FIG. 5).

Thereafter, cam ring 5 is kept in the intermediate-eccentricity holding position (see FIG. 5) for a while without any counterclockwise oscillating motion, until such time the discharge pressure D (the hydraulic pressure in control oil chamber 16) has reached the hydraulic pressure P2 and thus the spring load W1, produced by first coil spring 20, has been overcome by the force, which force is produced by hydraulic pressure introduced into the control oil chamber 16 and acts to decrease the eccentricity ϵ of cam ring 5. With the cam ring 5 kept at its intermediate-eccentricity holding position, the eccentricity ϵ of cam ring 5 is held to the predetermined eccentricity ϵ0 less than the cam-ring maximum eccentricity (see FIG. 1) and thus the pump discharge capacity (in other words, a rate of increase (rise) in discharge pressure D) tends to somewhat lower, as compared to that obtained by the cam-ring initial setting position of FIG. 1. Therefore, in the low- and mid-speed range, the discharge pressure D tends to moderately rise in accordance with an engine speed rise (see the discharge pressure D characteristic indicated by the solid line in FIG. 7 in the engine speed range A3).

Figure 6:
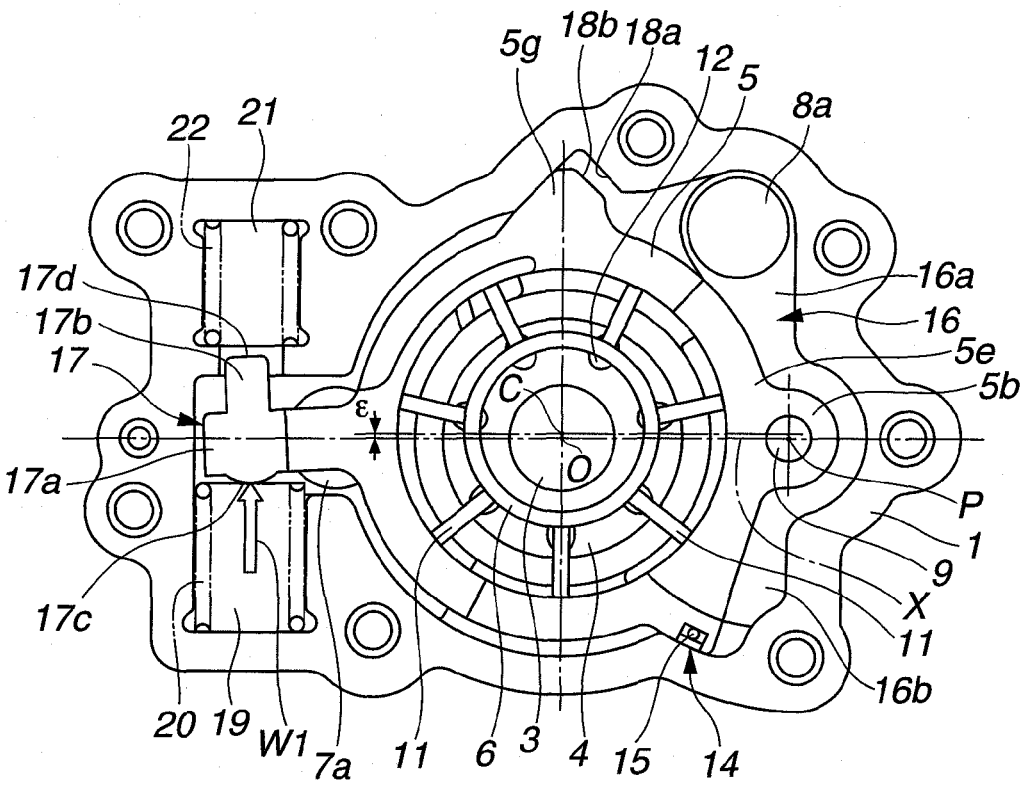
FIG. 6 is an explanatory view illustrating the operation of the variable displacement pump of the first embodiment in a small-eccentricity state (or a small-eccentricity position) where the cam-ring eccentricity $\epsilon$ becomes a small value less than the predetermined eccentricity $\epsilon 0$.

Once the discharge pressure D exceeds the hydraulic pressure P2 owing to a further engine speed rise, cam ring 5 begins to move counterclockwise from its intermediate-eccentricity holding position, while compressing the first coil spring 20 against the spring load W1 through the arm portion 17 (see FIG. 6). As a result, the eccentricity ϵ of cam ring 5 becomes less than the predetermined eccentricity ϵ0 and thus the pump discharge capacity (in other words, a rate of increase (rise) in discharge pressure D) tends to further lower. Therefore, in the mid- and high-speed range, the discharge pressure D tends to slowly rise in accordance with a further engine speed rise (see the discharge pressure D characteristic indicated by the solid line in FIG. 7 in the engine speed range A4).

As appreciated from comparison between the discharge pressure D characteristic "(d)" of the comparative example indicated by the two-dotted line in FIG. 7 and the discharge pressure D characteristic of the first embodiment indicated by the solid line in FIG. 7, in the mid- and high-speed range A4, according to the variable discharge pump of the first embodiment, the discharge pressure D characteristic can be brought closer to the desired discharge pressure D characteristic indicated by the broken line, thereby effectively suppressing an undesirable power loss (see the diagonal shading area within the mid- and high-speed range A4 in FIG. 7).

Figure 8:
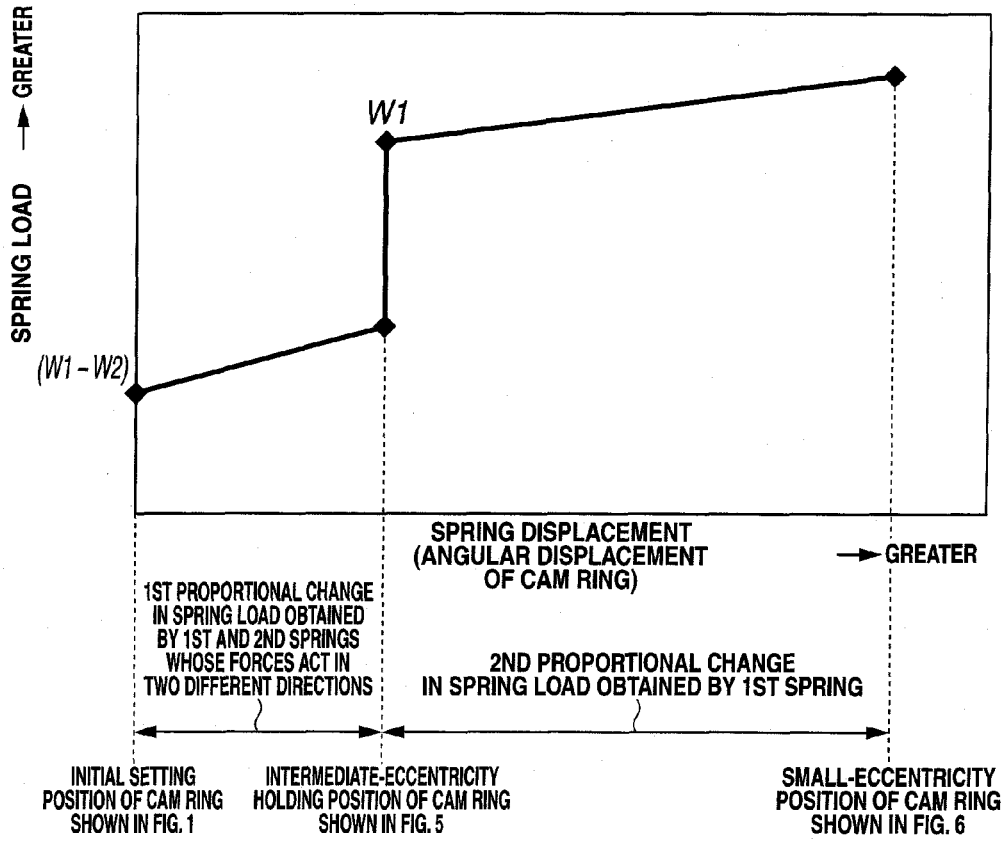
FIG. 8 is a characteristic diagram illustrating a specified nonlinear spring characteristic obtained by a biasing device (two opposed coil springs) installed in the variable displacement pump of the first embodiment, and showing the relationship between a spring displacement (i.e., an angular displacement of the cam ring) and a spring load.

Referring now to FIG. 8, there is shown the specified nonlinear spring characteristic obtained by the biasing device (two opposed coil springs 20 and 22) installed in the variable displacement pump of the first embodiment. The relationship between a spring displacement (i.e., an angular displacement of cam ring 5) and a spring load obtained by the biasing device (two opposed coil springs 20 and 22) is hereunder described in detail in reference to the specified nonlinear spring characteristic of FIG. 8, while linking the specified nonlinear spring characteristic of FIG. 8 to the Ne-D characteristic indicated by the solid line in FIG. 7.

In an engine speed range corresponding to the engine-startup- and very-low-speed range A1 of FIG. 7, the pump discharge pressure D does not yet reach the hydraulic pressure P1 (i.e., D<P1) and thus cam ring 5 is kept at its initial setting position (see FIG. 1) and thus the upward spring load W1, produced by first coil spring 20 and indicated by the voided vector in FIG. 1, acts on the underside of arm portion 17, whereas the downward spring load W2, produced by second coil spring 22 and indicated by the voided vector in FIG. 1, acts on the upside of arm portion 17. As a whole, the spring load difference (W1−W2) of two opposed coil springs 20 and 22 acts on the arm portion 17 (see the spring load indicated by the left-hand rhombic black-dot "◆" of FIG. 8).

In an engine speed range corresponding to the low-speed range A2 of FIG. 7, the pump discharge pressure D exceeds the hydraulic pressure P1 (i.e., P1≤D) and thus cam ring 5 moves counterclockwise from the initial setting position (see FIG. 1) toward the intermediate-eccentricity holding position (see FIG. 5) in accordance with a discharge pressure rise (an engine speed rise) and thus the magnitude of upward spring load W1, produced by first coil spring 20, tends to increase, whereas the magnitude of downward spring load W2, produced by second coil spring 22, tends to decrease. As a result, the spring load difference (W1−W2) also tends to increase. In this manner, within a speed range corresponding to the low-speed range A2 of FIG. 7, a combined spring load (W1−W2), obtained by first and second coil springs 20 and 22 whose spring forces act in different directions, provides a first proportional change between the spring load indicated by the left-hand rhombic black-dot "◆" of FIG. 8 and the spring load indicated by the intermediate-lower rhombic black-dot "◆" of FIG. 8. The gradient of the first proportional change in the combined spring load (W1−W2) of FIG. 8 means a combined spring constant of two opposed coil springs 20 and 22.

Thereafter, immediately when the angular position of cam ring 5 reaches the intermediate-eccentricity holding position shown in FIG. 5 owing to a further rise of discharge pressure D, the spring load W2, produced by second coil spring 22, does not act on the top face 17*d* of pushrod 17*b* of arm portion 17 anymore and thus the spring load, acting on the arm portion 17 of cam ring 5, is momentarily changed (discontinuously increased) from the spring load difference (W1−W2), obtained by two opposed coil springs 20 and 22, to the spring load W1, obtained by only the first coil spring 20 (see a discontinuous spring load change from the spring load (W1−W2) indicated by the intermediate-lower rhombic black-dot "◆" of FIG. 8 to the spring load W1 indicated by the intermediate-upper rhombic black-dot "◆" of FIG. 8). Hence, owing to the discontinuous spring load increase {(W1−W2)→W1}, cam ring 5 can be kept in the intermediate-eccentricity holding position (see FIG. 5) for a while without any counterclockwise oscillating motion, until such time the discharge pressure D (the hydraulic pressure in control oil chamber 16) has reached the hydraulic pressure P2 and thus the spring load W1, produced by first coil spring 20, has been overcome by the force, which force is produced by hydraulic pressure (discharge pressure) introduced into the control oil chamber 16 and acts to decrease the eccentricity ϵ of cam ring 5. In this manner, within a speed range corresponding to the low- and mid-speed range A3 of FIG. 7, the spring load W1, produced by only the first coil spring 20 immediately after the previously-discussed discontinuous spring load increase from the spring load (W1−W2) indicated by the intermediate-lower rhombic black-dot "◆" of FIG. 8 to the spring load W1 indicated by the intermediate-upper rhombic black-dot "◆" of FIG. 8, acts on the arm portion 17 for a while, until such time the hydraulic pressure P2 has been reached.

Once the discharge pressure D exceeds the hydraulic pressure P2 (i.e., P2<D) owing to a further engine speed rise and thus the spring load W1, produced by only the first coil spring 20 immediately after the previously-discussed discontinuous spring load increase {(W1−W2)→W1}, is overcome by the force, which force is produced by hydraulic pressure introduced into the control oil chamber 16, cam ring 5 begins to move counterclockwise from its intermediate-eccentricity holding position, while compressing the first coil spring 20 against the spring load W1 through the arm portion 17 (see FIG. 6). Thus, the magnitude of spring load W1, produced by only the first coil spring 20, tends to further increase, but only the first coil spring 20 exerts the spring load on the arm portion 17. Hence, within a speed range corresponding to the mid- and high-speed range A4 of FIG. 7, the spring load W1, produced by only the first coil spring 20, provides a second proportional change between the spring load indicated by the intermediate-upper rhombic black-dot "◆" of FIG. 8 and the spring load indicated by the right-hand rhombic black-dot "◆" of FIG. 8. Note that, according to the specific spring system configuration (including the specific spring chamber layout and two opposed coil springs 20 and 22 between which the arm portion 17 is laid out) of the variable displacement pump of the first embodiment, the gradient (corresponding to the spring constant of the first coil spring 20 itself) of the second proportional change in the spring load W1, produced by only the first coil spring 20, can be set to be less than the gradient (corresponding to the combined spring constant of two opposed coil springs 20 and 22 whose spring forces act in different rotation directions of cam ring 5) of the first proportional change in the combined spring load (W1−W2) of FIG. 8.

That is to say, according to the specific spring system configuration of the variable displacement pump of the shown embodiment, a biasing member, which serves to bias or force cam ring 5 in the direction that the eccentricity ϵ of cam ring 5 increases, is only the first biasing member (i.e., first coil spring 20), and therefore even during operation of the pump at high revolution speeds wherein, by way of discharge pressure introduced into the control oil chamber 6, cam ring 5 tends to be displaced to the direction that the eccentricity ϵ of cam ring 5 decreases, it is possible to enable a comparatively smooth counterclockwise oscillating motion of cam ring 5 in a mid- and high-speed range by virtue of a comparatively less spring constant of only the first biasing member (see the comparatively less gradient of the second proportional change in the mid- and high-speed range A4 in FIG. 8, which gradient is regarded as a spring constant of only the first biasing member, as compared to the comparatively greater gradient of the first proportional change in the low-speed range A2 in FIG. 8, which gradient is regarded as a combined spring constant of the first and second biasing members).

As discussed above, by virtue of the specified nonlinear spring characteristic, which is obtained by the biasing device (two opposed coil springs 20 and 22) and the gradient of the second proportional change in the spring load W1, produced by only the first coil spring 20 just after the spring-load discontinuity point, is less than the gradient of the first proportional change in the combined spring load (W1−W2), produced by first and second coil springs 20 and 22 just before the spring-load discontinuity point, the variable displacement pump of the first embodiment can bring the discharge pressure D characteristic (see the Ne-D characteristic indicated by the solid line of FIG. 7) closer to the Ne-D characteristic indicated by the broken line, over the entire range of engine speed from the startup- and very-low-speed range A1 to the mid- and high-speed range A4. Therefore, it is possible to adequately reduce an undesirable power loss (see the diagonal shading area within the mid- and high-speed range A4 in FIG. 7).

As will be appreciated from the above, the variable displacement pump of the first embodiment uses first and second coil springs 20 and 22, which are opposed to each other and whose spring forces W1 and W2 act on cam ring 5 in different rotation directions of cam ring 5. Therefore, such a specific spring system configuration (two opposed coil springs 20, 22) can be applied to various different pump discharge pressure/capacity characteristics, by way of proper settings of spring constants (a mean coil diameter, a wire diameter, a free height and the like) and/or preloads of the two opposed coil springs. In other words, it is possible to easily increase the degree of freedom of setting of a spring load suited to a required discharge pressure/capacity characteristic.

Additionally, in the first embodiment, the spring load W1, produced by first coil spring 20, and the spring load W2, produced by second coil spring 22, act directly on respective sides of arm portion 17 of cam ring 5 without any intermediate link such as a plunger. This contributes to a simplified spring system configuration, thus enabling reduced number of component parts, lower system installation time and costs, and easy manufacturing and assembling work.

Furthermore, in the first embodiment, the protrusion 17*c* of main arm body 17*a* of arm portion 17 is formed as a semi-spherical contacting surface, and the top face 17*d* of pushrod 17*b* of arm portion 17 is also formed as a curved surface. Additionally, as previously described, the angular displacement of cam ring 5 is small over the entire range of oscillating motion of cam ring 5, and thus an inclination angle of the axis of pushrod 17*b* with respect to the common axis of first and second spring chambers 19 and 21 is slight. Therefore, it is possible to minimize a change in contact-angle/contact-point between the top face of first coil spring 20 and the protrusion 17*c* of main arm body 17*a* and a change in contact-angle/contact-point between the bottom face 22*b* of second coil spring 22 and the top face 17*d* of pushrod 17*b*. That is, even when an undesirable inclination of first coil spring 20 and/or second coil spring 22 occurs during contraction and extension of each of first and second coil springs 20 and 22, it is possible to appropriately absorb the undesirable inclination by means of the protrusion 17*c* formed as a semi-spherical contacting surface and the top face 17*d* formed as a curved surface. This ensures a stable and smooth displacement (contraction and extension), in other words, a uniform direction of action of spring load W1, produced by first coil spring 20, and a uniform direction of action of spring load W2, produced by second coil spring 22.

In the shown embodiment, oil, discharged from discharge port 8, serves as lubricating oil for moving/sliding engine parts and also serves as a working medium (a driving source) as well as a lubricating substance for the VTC device. As described previously, the variable displacement pump of the first embodiment exhibits a good discharge pressure rise at the initial stage of pumping operation (see a rapid rise in discharge pressure D indicated by the solid line of FIG. 7 in the engine-startup- and very-low-speed range A1). Thus, even immediately after the engine startup, it is possible to enhance the phase-change control responsiveness of the VTC device provided for a phase change (phase-advance or phase-retard) of a camshaft relative to a timing sprocket.

As an example of various variable valve operating devices, in the shown embodiment, the VTC device is exemplified. As a matter of course, the variable displacement pump of the shown embodiment may be applied to another type of hydraulically-operated variable valve operating device, such as a variable valve lift (VVL) system or a continuously variable valve event and lift control (VEL) system.

In the shown embodiment, the discharge pressure from variable-volume pump chambers 13 on the discharge stroke during operation of the pump, serves as a force that oscillates cam ring 5 through the control oil chamber 16 (first and second control oil chambers 16*a*-16*b*). Thus, there is a possibility that the oscillating motion (the angular displacement) of cam ring 5 cannot be stably controlled in the presence of an undesirable hydraulic pressure drop in each of pump chambers 13 on the discharge stroke. In the variable displacement pump of the first embodiment, cam ring 5 is also formed with the fluid-communication groove pair (5*e*, 5*e*). By virtue of the fluid-communication groove pair (5*e*, 5*e*) of cam ring 5, it is possible to more smoothly introduce oil and/or oil bubbles (oil blended with air, in particular, within an oil pan) from variable-volume pump chambers 13, which chambers are defined and surrounded by vanes 11, the inner peripheral surface 5*a* of cam ring 5, the outer peripheral surface of rotor 4, and two opposed sidewalls (i.e., the bottom face 1*s* of pump housing 1 and the inside face of pump cover 2), into the control oil chamber 16. Thus, when the oil and/or oil bubbles are discharged, the discharged oil and/or oil bubbles can be introduced from variable-volume pump chambers 13 into the control oil chamber 16 at the shortest distance without rounding the outer periphery of cam ring 5. As a result, a hydraulic pressure on the inner peripheral side of cam ring 5 and a hydraulic pressure in the control oil chamber 16 are easy to accord with each other, thus effectively suppressing a localized hydraulic pressure fall in pump chamber 13. Hence, by the formation of the fluid-communication groove pair (5*e*, 5*e*), it is possible to stably control the oscillating motion (the angular displacement) of cam ring 5 even under a situation where a large amount of air may be mixed with oil.

Second Embodiment

Figure 9:
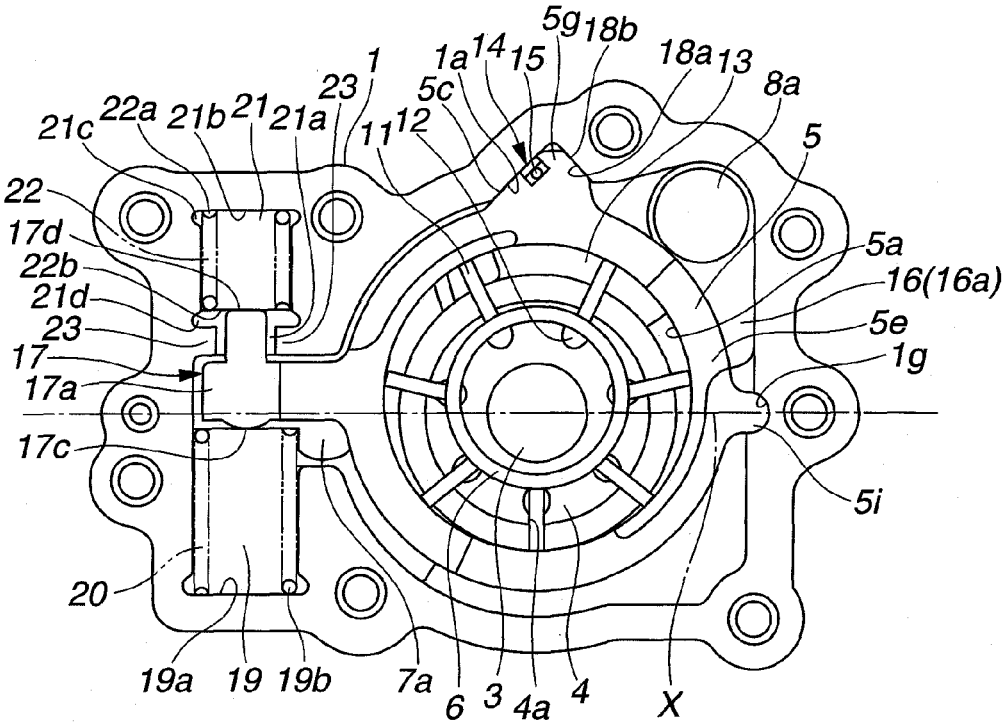
FIG. 9 is a front elevation view illustrating the internal construction of a variable displacement pump of the second embodiment in which a cam ring is kept at its initial setting position (the maximum-eccentricity angular position), but with a pump cover removed.
Figure 10:
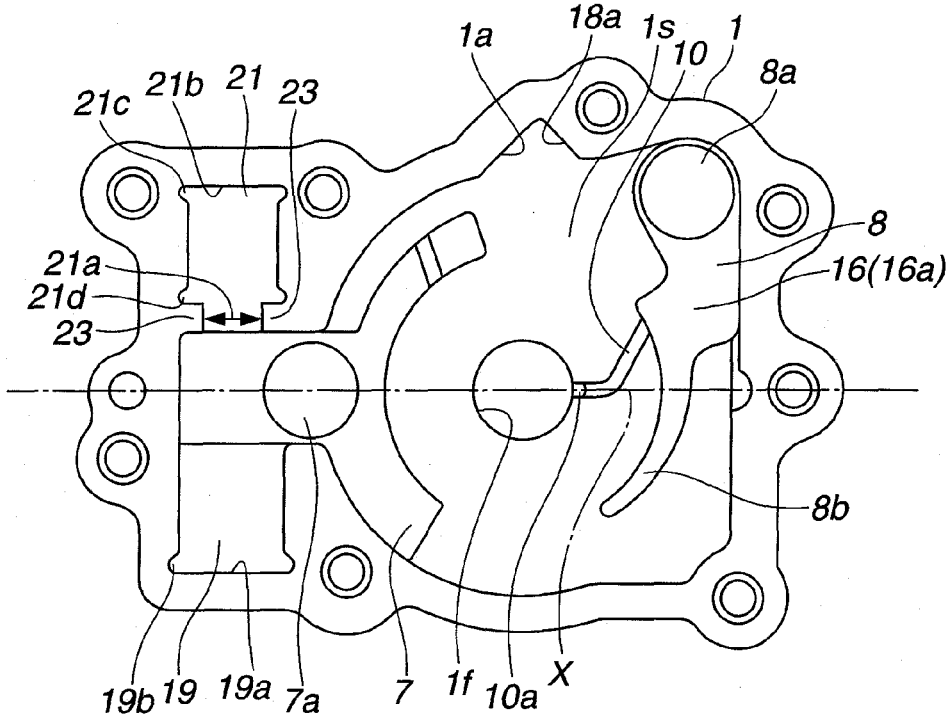
FIG. 10 is a front elevation view illustrating a pump housing of the variable displacement pump of the second embodiment.

Referring now to FIGS. 9-10, there is shown the variable displacement pump of the second embodiment. As can be seen from comparison between the pump configuration of FIGS. 1 and 4 (the first embodiment) and the pump configuration of FIGS. 9-10 (the second embodiment), the basic pump configurations are the same in the first and second embodiments. However, the structure of the fulcrum of oscillating motion of cam ring 5 and the structure of control oil chamber 16 of the second embodiment (see FIGS. 9-10) differ from those of the first embodiment.

As best seen in FIG. 9, as a fulcrum of oscillating motion of cam ring 5, the second embodiment uses a pivot portion 5*i* of the cam ring side and a pivot groove 1*g* of the pump housing side, without utilizing pivot pin 9. Pivot portion 5*i* is formed integral with the outer periphery of cam ring 5, facing the control oil chamber 16, and formed as a substantially semi-circular protrusion. Pivot groove 1*g* is recessed in the inner peripheral wall of pump housing 1 and formed as a semi-circular cutout configured to be substantially conformable to a shape of the semi-circular pivot portion 5*i*. As seen in FIG. 9, when assembling, the semi-circular pivot portion 5*i* of the cam ring side is fitted into the semi-circular pivot groove 1*g* of the pump housing side, to permit sliding-contact of pivot portion 5*i* with pivot groove 1*g*, in other words, pivotable support of cam ring 5.

As clearly seen in FIG. 10, in the second embodiment, the control oil chamber 16 is formed in only the upper half of the right-hand half discharge area of the pump body with respect to the cam-ring reference line "X". That is, the shape (the discharge area) of discharge port 8 is maximum at the first control oil chamber 16*a* above the cam-ring reference line "X", and also formed as a downwardly-elongated, substantially crescent discharge area 8*b* below the cam-ring reference line "X". Note that, as seen from FIGS. 9-10, the downwardly-elongated crescent discharge area 8*b* is formed inside of the outer peripheral surface of cam ring 5, so as not to contribute to oscillating motion (angular displacement) of cam ring 5. With the previously-discussed control oil chamber structure (16*a*) and cam-ring pivot structure (5*i*, 1*g*), the discharge pressure, introduced into the control oil chamber 16 (exactly, the first control oil chamber 16*a* in the second embodiment) acts on the outer peripheral surface of cam ring 5 so as to produce a counterclockwise oscillating motion (or a counterclockwise pivotal motion) of cam ring 5 about the pivot (i.e., pivot portion 5*i* serving as a fulcrum) in a direction that the eccentricity ϵ of the geometric center "C" of cam ring 5 to the axis "O" of rotation of rotor 4 decreases.

With the previously-discussed control oil chamber structure (16*a*) and cam-ring pivot structure (5*i*, 1*g*), in the second embodiment, the pivot portion 5*i* of the cam ring side and the pivot groove 1*g* of the pump housing side cooperate with each other to form a leakproof seal by the sealing surfaces consisting of pivot portion 5*i* and pivot groove 1*g*, in sliding-contact with each other, so as to suppress an internal oil leakage from one side of control oil chamber 16 (16*a*) to the low-pressure side to a minimum. On the other hand, in a similar manner to the first embodiment, a second seal member 14 and a rubber elastic member 15 are both fitted and attached onto the innermost end face of a seal-retention groove formed in the sliding-contact surface 5*c* of cam ring 5. The sealing surface 1*a* of pump housing 1 and the second seal member 14 of cam ring 5, abutted each other, provides a good leakproof seal, thus suppressing an internal oil leakage from the other side of control oil chamber 16 (16*a*) to the low-pressure side to a minimum.

The variable displacement pump of the second embodiment is suitable and advantageous, when a required hydraulic pressure of an internal combustion engine is low or when an axial width of a cam ring is limited (narrow). That is, as compared to the pump structure of the first embodiment, in the case of the pump structure of the second embodiment, an input, exerted on the outer peripheral surface of cam ring 5 through the control oil chamber 16 (the first control oil chamber 16*a*) under discharge pressure, is comparatively small. This means the increased degree of freedom of setting of a spring load, produced by first coil spring 20 functioning to permanently bias cam ring 5 toward the initial setting position, thereby enabling more-precise setting of a specified nonlinear spring characteristic obtained by coil springs 20 and 22.

In the second embodiment, pivot portion 5*i*, serving as a fulcrum of oscillating motion of cam ring 5, is integrally formed with cam ring 5 as a substantially semi-circular protrusion. In lieu thereof, the pivot portion 5*i* may be somewhat enlarged and formed with a pivot bore, so that a pivot pin can be inserted and fitted into the pivot bore and simultaneously fitted into pin insertion holes of pump housing 1 and cover 2, and that the outer periphery of pivot portion 5*i* is kept in sliding-contact with the pivot groove 1*g* recessed in the inner peripheral wall of pump housing 1.

In the second embodiment, to enhance the fluid-tightness of the control oil chamber 16 (the first control oil chamber 16*a*), the seal member 14 is installed on the cam ring 5. Depending on a degree of a required discharge pressure characteristic of an internal combustion engine, such a seal member 14 may be eliminated, for the purpose of reduced number of component parts and lower system installation time and costs.

Third Embodiment

Figure 11:
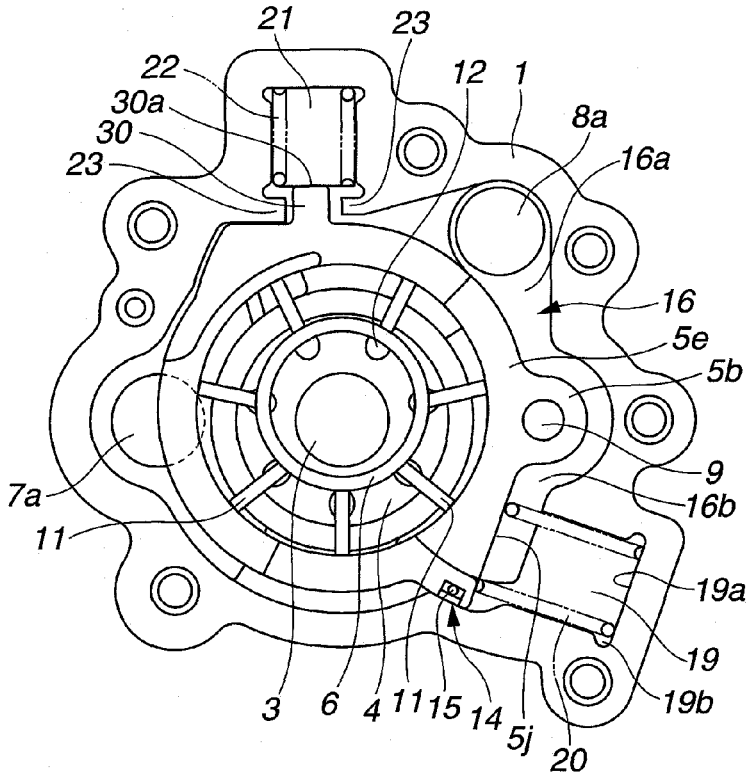
FIG. 11 is a front elevation view illustrating the internal construction of a variable displacement pump of the third embodiment in which a cam ring is kept at its initial setting position (the maximum-eccentricity angular position), but with a pump cover removed.
Figure 12:
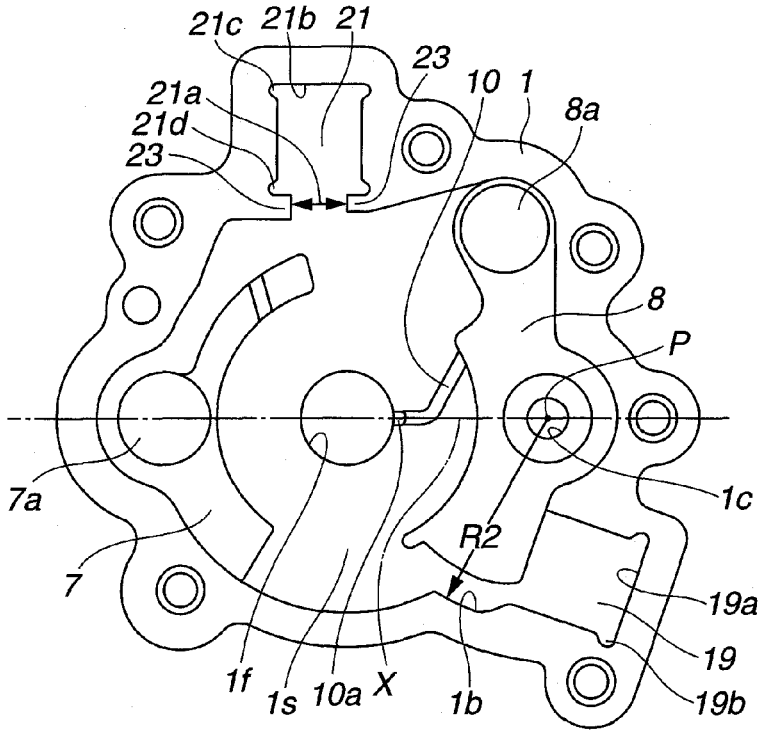
FIG. 12 is a front elevation view illustrating a pump housing of the variable displacement pump of the third embodiment.

Referring now to FIGS. 11-12, there is shown the variable displacement pump of the third embodiment. As can be seen from comparison between the pump configuration of FIGS. 1 and 4 (the first embodiment) and the pump configuration of FIGS. 11-12 (the third embodiment), the basic pump configurations are the same in the first and third embodiments. However, the installation locations of first and second coil springs 20 and 22 of the third embodiment (see FIGS. 11-12) differ from those of the first embodiment.

As seen in FIGS. 11-12, first spring chamber 19 is located at an angular position (see the direction of 4 o'clock) substantially corresponding to the second oil control chamber 16*b*, whereas second spring chamber 21 is located at an angular position (see the direction of 12 o'clock) corresponding to the topside of pump housing 1.

The bottom face (i.e., the right-hand end face of first coil spring 20, viewing FIG. 11) of first coil spring 20, accommodated in first spring chamber 19, is kept in elastic-contact with the bottom face 19*a* of first spring chamber 19. On the other hand, the top face of first coil spring 20 (i.e., the left-hand end face of first coil spring 20, viewing FIG. 11) is kept in elastic-contact directly with a right side face 5*j* of the triangular lower-right cam-ring protrusion. By such a specific layout of first coil spring 20, the spring load W1, produced by first coil spring 20, acts to bias the cam ring 5 in a direction that the eccentricity ϵ of cam ring 5 increases.

The top face of second coil spring 22, accommodated in second spring chamber 21, is kept in elastic-contact with the bottom face 21*b* of second spring chamber 21. On the other hand, the bottom face of second coil spring 22 is kept in elastic-contact directly with a top face 30*a* of a pushrod 30, formed integral with the uppermost end of cam ring 5. By such a layout of second coil spring 22, the spring load W2, produced by second coil spring 22, acts to bias the cam ring 5 in a direction that the eccentricity ϵ of cam ring 5 decreases. That is, the spring load W1, produced by first coil spring 20, and the spring load W2, produced by second coil spring 22, act in different rotation directions of the cam ring.

In a similar manner to the pump housing structure of the first embodiment, in the third embodiment, as seen from FIGS. 11-12, pump housing 1 has a pair of opposed shoulder portions 23, 23 integrally formed to inwardly protrude toward the axis of second spring chamber 21 in a manner so as to define the lower opening end 21*a* of second spring chamber 21 between them. The lower opening end 21*a*, defined between opposed shoulder portions 23, 23, is configured to permit the pushrod 30 of the cam ring to move toward or apart from the lower end of second spring chamber 21 therethrough. By virtue of the distance between opposed shoulder portions 23, 23, dimensioned to be slightly shorter than the coil outside diameter of second coil spring 22, and almost equal to the coil inside diameter, the opposed shoulder pair (23, 23) serves as a stopper that restricts a maximum extended stroke (an extensible deformation) of second coil spring 22. When a predetermined counterclockwise displacement of the cam ring, corresponding to the predetermined eccentricity ϵ0, has been reached in accordance with a discharge pressure rise, the cam ring can be kept at its intermediate-eccentricity holding state by abutment of the bottom face 22*b* of second coil spring 22 and the opposed shoulder pair (23, 23), in other words, owing to a discontinuous spring load increase {(W1−W2)→W1}, for a while without any counterclockwise oscillating motion, until such time the discharge pressure D has reached the hydraulic pressure P2 and thus the spring load W1, produced by only the first coil spring 20 immediately after the previously-discussed discontinuous spring load increase {(W1−W2)→W1}, has been overcome by the force, which force is produced by hydraulic pressure introduced into the control oil chamber 16 (first and second control oil chambers 16*a*-16*b*) and acts to decrease the cam-ring eccentricity ϵ. In a similar manner to the top face 17*d* of pushrod

17*b* of the pump of the first embodiment, in the third embodiment, the top face 30*a* of pushrod 30 is formed as a curved surface having a small radius of curvature.

In a similar manner to the first embodiment, in the third embodiment, pivot portion 5*b* of the cam ring is rotatably supported by means of the pivot pin 9 in such a manner as to be pivotable about the pivot pin. Also, control oil chamber 16 is constructed by the first and second control oil chambers 16*a*-16*b*.

As discussed above, in the third embodiment, the first coil spring 20 laid out near the lower right portion of the cam ring and the second coil spring 22 laid out near the upper portion of the cam ring can provide the specified nonlinear spring characteristic as shown in FIG. 8.

Therefore, by means of the first and second coil springs 20 and 22 whose spring loads W1 and W2 act in different rotation directions of the cam ring, and the control oil chamber 16, constructed by first and second control oil chambers 16*a*-16*b*, the variable discharge pump of the third embodiment can provide the same operation and effects as the first embodiment. Additionally, by virtue of the specific layout of first and second spring chambers 19 and 21 that the spring load W1 of first coil spring 20 and the spring load W2 of second coil spring 22 directly act on respective contact points of the cam ring, without forming any arm portion extending radially outwards from the main cylindrical portion of the cam ring. This contributes to a more simplified spring system configuration, thus enabling downsized pump configuration, lower system installation time and costs, and easy manufacturing and assembling work.

In the first to third embodiments, the variable displacement pump is exemplified in an internal combustion engine of an automotive vehicle. In lieu thereof, the variable displacement pump of the shown embodiments may be applied to another equipment, such as a hydraulically-operated construction equipment.

The entire contents of Japanese Patent Application No. 2009-266950 (filed Nov. 25, 2009) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable displacement pump comprising:

a rotor driven by an internal combustion engine;

a plurality of vanes fitted into an outer periphery of the rotor to be retractable and extendable in a radial direction of the rotor;

a cam ring configured to accommodate therein the rotor and the vanes and configured to define a plurality of working chambers in cooperation with an outer peripheral surface of the rotor and two axially opposed sidewalls facing respective side faces of the cam ring, and further configured to change an eccentricity of a geometric center of the cam ring to an axis of rotation of the rotor by a displacement of the cam ring relative to the rotor;

a housing configured to accommodate therein the cam ring and having an inlet portion and a discharge portion formed in at least one of the two axially opposed sidewalls, the inlet portion being configured to open into the working chambers whose volumes increase during rotation of the rotor in an eccentric state of the geometric center of the cam ring to the axis of rotation of the rotor, and the discharge portion being configured to open into the working chambers whose volumes decrease during rotation of the rotor in the eccentric state of the geometric center of the cam ring to the axis of rotation of the rotor;

a first biasing member configured to force the cam ring by a first force in a first direction that the eccentricity of the geometric center of the cam ring to the axis of rotation of the rotor increases;

a second biasing member configured to force the cam ring by a second force less than the first force in a second direction that the eccentricity of the geometric center of the cam ring to the axis of rotation of the rotor decreases, when the eccentricity of the geometric center of the cam ring is greater than or equal to a predetermined eccentricity, and further configured to be held in a specified preload state without any application of the second force to the cam ring, when the eccentricity of the geometric center of the cam ring is less than the predetermined eccentricity; and a control oil chamber configured to move the cam ring against the first force of the first biasing member by a discharge pressure introduced into the control oil chamber.

2. A variable displacement pump comprising:

a rotor driven by an internal combustion engine;

a plurality of vanes fitted into an outer periphery of the rotor to be retractable and extendable in a radial direction of the rotor;

a cam ring configured to accommodate therein the rotor and the vanes and configured to define a plurality of working chambers in cooperation with an outer peripheral surface of the rotor and two axially opposed sidewalls facing respective side faces of the cam ring, and further configured to change an eccentricity of a geometric center of the cam ring to an axis of rotation of the rotor by a displacement of the cam ring relative to the rotor;

a housing configured to accommodate therein the cam ring and having an inlet portion and a discharge portion formed in at least one of the two axially opposed sidewalls, the inlet portion being configured to open into the working chambers whose volumes increase during rotation of the rotor in an eccentric state of the geometric center of the cam ring to the axis of rotation of the rotor, and the discharge portion being configured to open into the working chambers whose volumes decrease during rotation of the rotor in the eccentric state of the geometric center of the cam ring to the axis of rotation of the rotor;

a first coil spring configured to be always kept in abutted-engagement with the cam ring to force the cam ring by a first spring load in a first direction that the eccentricity of the geometric center of the cam ring to the axis of rotation of the rotor increases;

a second coil spring configured to be kept out of contact with the cam ring, while being held in a compressed state, when the eccentricity of the geometric center of the cam ring is less than the predetermined eccentricity, and further configured to force the cam ring by a second spring load, produced by the second coil spring, which second coil spring is brought into abutted-engagement with the cam ring, and less than the first spring load, in a second direction that the eccentricity of the geometric center of the cam ring to the axis of rotation of the rotor decreases, when the eccentricity of the geometric center of the cam ring is greater than or equal to a predetermined eccentricity; and a control oil chamber configured to move the cam ring against the first spring load of the first coil spring by a discharge pressure introduced into the control oil chamber.

3. A variable displacement pump comprising:

a rotor driven by an internal combustion engine;

a pump structural member configured to change a volume of each of a plurality of working chambers by rotation of the rotor, so as to introduce oil through an inlet portion into the working chambers and to discharge the oil through discharge portion;

a variable mechanism configured to variably adjust the volumes of the working chambers, which chambers open into the discharge portion, by a displacement of a movable member, caused by a discharge pressure of the oil discharged from the discharge portion;

a first biasing member configured to force the movable member by a first force in a first direction that a rate of change of the volume of each of the working chambers increases;

a second biasing member configured to force the movable member by a second force less than the first force in a second direction that a rate of change of the volume decreases, under a state where the movable member has been displaced to a position that the rate of change of the volume is greater than or equal to a predetermined value, and further configured to be held in a specified preload state without any application of the second force to the movable member, under a state where the movable member has been displaced to a position that the rate of change of the volume is less than the predetermined value; and a control oil chamber configured to move the movable member against the first force of the first biasing member by a discharge pressure introduced into the control oil chamber.

4. The variable displacement pump as claimed in claim 2, wherein:

the cam ring has a radially-protruding arm portion formed on its outer periphery, and the first and second coil springs are laid out on both sides of the arm portion in opposite directions of the displacement of the cam ring.

5. The variable displacement pump as claimed in claim 4, wherein:

the second coil spring is accommodated in a second spring chamber, which is formed in the housing and whose longitudinal length is dimensioned to be shorter than a free height of the second coil spring;

the radially-protruding arm portion has a pushrod integrally formed on a side of the arm portion facing the second coil spring in a manner so as to extend toward the second coil spring; and the housing has a pair of opposed shoulder portions between which an opening end of the second spring chamber is defined to permit the pushrod to move toward or apart from the second spring chamber through the opening end.

6. The variable displacement pump as claimed in claim 5, wherein:

the first coil spring is accommodated in a first spring chamber, which is formed in the housing on a side of the arm portion facing apart from the second coil spring in a manner so as to be opposed to the second spring chamber.

7. The variable displacement pump as claimed in claim 6, wherein:

the housing comprises a housing body including a first one of the two axially opposed sidewalls and the second sidewall of the two axially opposed sidewalls fixedly connected to the housing body;

the first spring chamber, the second spring chamber and the opening end are formed in the first sidewall of the housing body; and an opening end of the housing body is hermetically closed by the second sidewall.

8. The variable displacement pump as claimed in claim 7, wherein:

the first spring chamber has a spring seat, which is kept in elastic-contact with the first coil spring and whose corner is further machined as a recessed groove; and the second spring chamber has a spring seat, which is kept in elastic-contact with the second coil spring and whose corner is further machined as a recessed groove.

9. The variable displacement pump as claimed in claim 6, wherein:

the cam ring is installed on the housing to be pivotable about a fulcrum of oscillating motion of the cam ring, which fulcrum is laid out so that the fulcrum of oscillating motion of the cam ring and the arm portion are arranged on opposite sides of the axis of rotation of the rotor; and the radially-protruding arm portion has a semi-spherical contacting surface protrusion, which protrusion is integrally formed on a side of the arm portion facing the first coil spring and kept in elastic-contact with the first coil spring.

10. The variable displacement pump as claimed in claim 2, wherein:

the control oil chamber comprises two control oil chambers defined between the cam ring and the housing, a first one of the two control oil chambers acting on a first part of an outer peripheral surface of the cam ring to decrease the eccentricity of the geometric center of the cam ring to the axis of rotation of the rotor, and the second control oil chamber acting on a second part of the outer peripheral surface of the cam ring to increase the eccentricity of the geometric center of the cam ring to the axis of rotation of the rotor; and a pressure-receiving area of the first control oil chamber is set to be greater than that of the second control oil chamber.

11. The variable displacement pump as claimed in claim 10, wherein:

the cam ring is rotatably supported by a pivot pin to be pivotable about the pivot pin, which pivot pin is laid out so that the pivot pin and the arm portion are arranged on opposite sides of the axis of rotation of the rotor; and the first and second control oil chambers are laid out to be continuous with each other in opposite directions of oscillating motion of the cam ring about the pivot pin.

12. The variable displacement pump as claimed in claim 11, wherein:

the cam ring is integrally formed with a first seal portion protruding from the first part of the outer peripheral surface of the cam ring and a second seal portion protruding from the second part of the outer peripheral surface of the cam ring;

a first circular-arc sealing surface pair is formed by an inner peripheral surface of the housing and the first seal portion of the cam ring;

a second circular-arc sealing surface pair is formed by the inner peripheral surface of the housing and the second seal portion of the cam ring; and the control oil chamber is partitioned by the first and second sealing surface pairs.

13. The variable displacement pump as claimed in claim 12, wherein:

a third sealing surface pair is formed by abutment of the first seal portion of the cam ring and the inner peripheral surface of the housing, which are brought into abutted-engagement with each other in a maximum-eccentricity state where the eccentricity of the geometric center of the cam ring to the axis of rotation of the rotor becomes maximum.

14. The variable displacement pump as claimed in claim 12, wherein:

an inlet pressure is introduced into an internal space defined between the inner peripheral surface of the housing and a third part of the outer peripheral surface of the cam ring except the control oil chamber, partitioned by the first and second sealing surface pairs.

15. The variable displacement pump as claimed in claim 12, wherein:

a seal member (14) is disposed between the second seal portion (5*h*) and the inner peripheral surface (1*b*) of the housing (1).

16. The variable displacement pump as claimed in claim 2, wherein:

the housing is made of aluminum alloy materials, whereas the cam ring is made of iron-based sintered alloy materials.

17. The variable displacement pump as claimed in claim 2, wherein:

oil, pressurized by the working chambers, is discharged through the discharge portion via the control oil chamber.

18. The variable displacement pump as claimed in claim 3, wherein:

the second biasing member is configured so as not to apply the second force to the movable member under a state where a maximum extended stroke of the second biasing member has been restricted by means of a stopper.

* * * * *